US010822944B1

(12) United States Patent
Camacho Cardenas

(10) Patent No.: US 10,822,944 B1
(45) Date of Patent: Nov. 3, 2020

(54) ACTIVE DRILLING MUD PRESSURE PULSATION DAMPENING

(71) Applicant: Schlumberger Technology Corporation, Sugar Land, TX (US)

(72) Inventor: Alejandro Camacho Cardenas, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 17 days.

(21) Appl. No.: 16/382,756

(22) Filed: Apr. 12, 2019

(51) Int. Cl.

| | |
|---|---|
| ***E21B 47/18*** | (2012.01) |
| ***E21B 21/08*** | (2006.01) |
| *F04B 9/02* | (2006.01) |
| *F04B 23/06* | (2006.01) |
| *F04B 15/02* | (2006.01) |

(52) U.S. Cl.
CPC ..... *E21B 47/18* (2013.01); *E21B 21/08* (2013.01); *F04B 9/02* (2013.01); *F04B 15/02* (2013.01); *F04B 23/06* (2013.01)

(58) Field of Classification Search
None
See application file for complete search history.

(56) References Cited

U.S. PATENT DOCUMENTS 3,931,755 A * 1/1976 Hatridge ..... B05B 9/0413 92/155
4,351,037 A * 9/1982 Scherbatskoy ..... E21B 41/0085 367/85
4,830,122 A * 5/1989 Walter ..... E21B 7/18 175/106
5,190,114 A * 3/1993 Walter ..... E21B 7/18 166/177.7
5,487,621 A * 1/1996 Takada ..... E02B 9/06 405/80
5,490,121 A * 2/1996 Gardner ..... E21B 47/18 340/853.1
5,909,982 A * 6/1999 Takada ..... E02B 11/00 405/52

(Continued)

OTHER PUBLICATIONS

Vetter et al., "Pressure Pulsation Dampening Methods for Reciprocating Pumps", Proceedings of the Tenth International Pump Users Symposium, Jan. 1, 1993, pp. 25-39.

*Primary Examiner* — Curtis J King
(74) *Attorney, Agent, or Firm* — Rachel E. Greene

(57) ABSTRACT

Apparatus and method for reducing pressure pulsations within drilling mud being pumped downhole by a plurality of pumps to thereby improve quality of mud-pulse telemetry. The apparatus may include a position sensor disposed in association with each pump and operable to generate a position signal indicative of operational timing of a corresponding one of the pumps, a surface telemetry device fluidly connected with the drilling mud and operable to output a telemetry quality signal indicative of the quality of mud-pulse telemetry, and a controller communicatively connected with the pumps, the position sensors, and the surface telemetry device. The controller may be operable to receive the position signal and the telemetry quality signal, and cause the pumps to change relative operational timing of the pumps based on the position signal and the telemetry quality signal to improve the quality of mud-pulse telemetry.

20 Claims, 6 Drawing Sheets

(56) References Cited

U.S. PATENT DOCUMENTS 5,911,564 A * 6/1999 Sawyer ..... F02B 63/06 417/369
5,992,517 A * 11/1999 McAnally ..... E21B 43/121 166/105
7,921,937 B2 4/2011 Brackin et al.
7,980,326 B2 7/2011 Tibbitts et al.
8,201,628 B2 6/2012 Lovorn et al.
8,261,826 B2 9/2012 Lovorn et al.
8,281,875 B2 10/2012 Lovorn et al.
8,347,957 B2 1/2013 Stephenson et al.
8,397,836 B2 3/2013 Pool et al.
8,833,488 B2 9/2014 Knudsen et al.
8,899,348 B2 12/2014 Henderson et al.
8,905,157 B2 12/2014 Jiao et al.
9,003,955 B1 * 4/2015 Stang ..... B26F 3/004 92/73
9,080,407 B2 7/2015 Bernard
9,169,700 B2 10/2015 Curtis et al.
9,249,638 B2 2/2016 Bernard
2003/0151978 A1 * 8/2003 Jeffryes ..... E21B 47/18 367/83
2008/0024319 A1 * 1/2008 Close ..... G01V 11/00 340/854.3
2009/0260826 A1 * 10/2009 Sherwood ..... E21B 41/0057 166/305.1
2010/0098568 A1 * 4/2010 Marica ..... F04B 53/001 417/559
2010/0110833 A1 * 5/2010 Close ..... G01V 11/00 367/83
2010/0188253 A1 * 7/2010 Shearer ..... H04L 25/4902 340/853.3
2011/0011594 A1 * 1/2011 Young ..... E21B 47/24 166/321
2011/0123363 A1 * 5/2011 Marica ..... F04B 5/00 417/279
2011/0169655 A1 * 7/2011 Close ..... G01V 11/002 340/853.6
2011/0180740 A1 * 7/2011 Marica ..... F04B 23/10 251/321
2011/0250084 A1 * 10/2011 Marica ..... F04B 23/10 417/540
2011/0267922 A1 * 11/2011 Shampine ..... E21B 47/005 367/25
2012/0076666 A1 * 3/2012 Romain ..... F04B 49/20 417/42
2012/0223267 A1 * 9/2012 Marica ..... F04B 37/14 251/333
2013/0112404 A1 * 5/2013 Lovorn ..... E21B 33/085 166/250.01
2014/0299377 A1 10/2014 Abbassian et al.
2015/0292281 A1 * 10/2015 Hardin, Jr. ..... E21B 21/103 166/374
2015/0361745 A1 * 12/2015 Guerra ..... E21B 21/08 417/437
2016/0010638 A1 * 1/2016 Margolis ..... F04B 53/16 175/48
2016/0248143 A1 * 8/2016 Hensarling ..... G01V 3/30
2016/0258287 A1 * 9/2016 Kolle ..... E21B 47/18
2017/0089156 A1 * 3/2017 Spencer ..... E21B 21/08
2017/0089328 A1 * 3/2017 Sato ..... F04B 51/00
2017/0226813 A1 8/2017 Northam et al.
2018/0003171 A1 * 1/2018 Rashid ..... E21B 33/13
2018/0016858 A1 * 1/2018 Aamo ..... E21B 21/08
2018/0149174 A1 5/2018 Zapico et al.
2018/0149175 A1 5/2018 Zapico
2018/0187540 A1 * 7/2018 Hanski ..... E21B 21/00
2018/0245461 A1 * 8/2018 Barak ..... H04L 25/03
2018/0291708 A1 * 10/2018 Akkerman ..... E21B 43/26
2018/0298887 A1 * 10/2018 Jiang ..... F04B 15/02
2019/0242208 A1 * 8/2019 Estrada-Giraldo ..... E21B 31/06
2019/0316592 A1 * 10/2019 Jenkins ..... F04D 15/0088
2020/0109604 A1 * 4/2020 Elfar ..... E21B 7/24
2020/0132237 A1 * 4/2020 Rogers ..... F16L 55/04

* cited by examiner

ACTIVE DRILLING MUD PRESSURE PULSATION DAMPENING

BACKGROUND OF THE DISCLOSURE

Wells are generally drilled into the ground or ocean bed to recover natural deposits of oil, gas, and other materials that are trapped in subterranean formations. Well construction operations (e.g., drilling operations) may be performed at a wellsite by a drilling system (i.e., a drill rig) having various automated surface and subterranean equipment operating in a coordinated manner. For example, a drive mechanism, such as a top drive or rotary table located at a wellsite surface, may be utilized to rotate and advance a drill string into a subterranean formation to drill a wellbore. The drill string may include a plurality of drill pipes coupled together and terminating with a drill bit. Length of the drill string may be increased by adding additional drill pipes while depth of the wellbore increases. Drilling fluid (i.e., mud) may be pumped by mud pumps from the wellsite surface down through the drill string to the drill bit. The drilling fluid lubricates and cools the drill bit, and carries drill cuttings from the wellbore back to the wellsite surface. The drilling fluid returning to the surface may then be cleaned and again pumped through the drill string.

During such well drilling operations, mud-pulse telemetry may be utilized to communicate information between surface equipment and a bottom-hole assembly (BHA) and/or other downhole components of the drill string. Mud-pulse telemetry transmits information between the surface equipment and the BHA in the form of modulated pressure pulses that propagate through the drilling fluid circulated down through the drill string, including the BHA by the mud pumps. For example, surface equipment may be utilized to transmit commands and other information to a measurement-while-drilling (MWD) tool of the BHA via the mud-pulse telemetry. The MWD tool may include various sensors utilized to acquire data related to a subterranean formation, which may then be transmitted to the surface equipment via the mud-pulse telemetry.

Mud pumps are typically reciprocating pumps comprising reciprocating members (e.g., pistons, plungers, diaphragms, etc.) driven by a crankshaft toward and away from a fluid chamber to alternatingly draw in, pressurize, and expel drilling fluid from the fluid chamber. Each reciprocating member discharges the drilling fluid from its fluid chamber in an oscillating manner, resulting in the drilling fluid having pressure pulsations (i.e., fluctuations, spikes) at pump outlets. The pressurized drilling fluid is then transmitted through pipes and other fluid conduits connected downstream from the pumps. The pressure pulsations within the drilling fluid may cause "noise" in signals or information (e.g., telemetry data) transmitted via mud-pulse telemetry between wellsite surface and downhole instrumentation. Pressure pulsations within the drilling fluid may also decrease performance of certain downhole operations, such as drilling operations, and may cause failures in piping, hose, and other downstream equipment. Pressure pulsations may also be amplified in pumping systems comprising two or more reciprocating pumps due to resonance phenomena caused by interaction of two or more fluid flows, further exacerbating harmful or otherwise unintended effects of pressure pulsations.

Gas-charged pulsation dampeners may be connected at pump outlets to dampen or otherwise reduce magnitude of the pressure pulsations generated by the pumps. Such dampeners may include a gas-charged bladder within an internal chamber. During drilling operations, pressure pulsations within the pumped drilling fluid compress the gas within the pulsation dampener, thereby reducing magnitude of the pressure pulsations transmitted downstream. The gas-charged pulsation dampeners operate optimally when pressure of the gas charge is set to match operating pressure of the pumps. However, pump operating pressure often varies during an oilfield pumping operation or between different jobs or job stages. For example, during drilling operations, pump pressure may vary based on well depth, whereby a pump may operate at lower pressures at shallow depths and at higher pressures at greater depths, such as when drilling in production zones. Typically, a gas-charged pulsation dampener is charged to an average pressure of anticipated minimum and maximum pump operating pressures. However, charging the pulsation dampener to a single pressure results in less than optimal pulsation dampening effects because the gas charge does not match the operating pump pressure throughout entirety of the pumping operations, resulting in appreciable pressure pulsations being transmitted downstream from the pulsation dampeners.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a system for reducing pressure pulsations within drilling mud being pumped downhole by multiple pumps. The system includes a pressure pulse generator fluidly connected with the drilling mud, a pressure sensor to generate a pressure signal indicative of the pressure pulsations within the drilling mud, a position sensor disposed in association with each pump to generate a position signal indicative of operational timing of a corresponding one of the pumps, and a controller including a processor and memory storing computer program code. The controller is communicatively connected with the pumps, the pressure pulse generator, the pressure sensor, and the position sensors. The controller receives the pressure and position signals, causes the pumps to change relative operational timing of the pumps based on the position and pressure signals to reduce the pressure pulsations within the drilling mud, and causes the pressure pulse generator to impart pressure pulsations to the drilling mud based on the pressure signal to reduce the pressure pulsations within the drilling mud.

The present disclosure also introduces an apparatus including a system for reducing pressure pulsations within drilling mud being pumped downhole by multiple pumps to thereby improve quality of mud-pulse telemetry. The system includes a position sensor disposed in association with each pump to generate a position signal indicative of operational timing of a corresponding one of the pumps, a surface telemetry device located at a wellsite surface, and a downhole telemetry device located downhole. The surface telemetry device and the downhole telemetry device communicate with each other via mud-pulse telemetry. At least one of the surface telemetry device and downhole telemetry device outputs a telemetry quality signal indicative of quality of the communications between the surface telemetry device and downhole telemetry device. The system also includes a controller having a processor and memory storing computer program code. The controller is communicatively connected with the pumps, the position sensors, the surface telemetry device, and the downhole telemetry device. The controller receives the position signal and the telemetry quality signal and causes the pumps to change relative operational timing of the pumps based on the position signal and the telemetry quality signal to improve the quality of mud-pulse telemetry.

The present disclosure also introduces a method for reducing pressure pulsations within drilling mud being pumped downhole by multiple pumps to thereby improve quality of mud-pulse telemetry. The method includes generating a position signal indicative of operational timing of a corresponding one of the pumps, generating a pressure signal indicative of the pressure pulsations within the drilling mud, and operating a controller having a processor and memory storing computer program code to receive the pressure and position signals, cause the pumps to change operational timing relative to each other based on the position and pressure signals to reduce the pressure pulsations within the drilling mud, and cause a pressure pulse generator to impart pressure pulsations to the drilling mud based on the pressure signal to reduce the pressure pulsations within the drilling mud.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
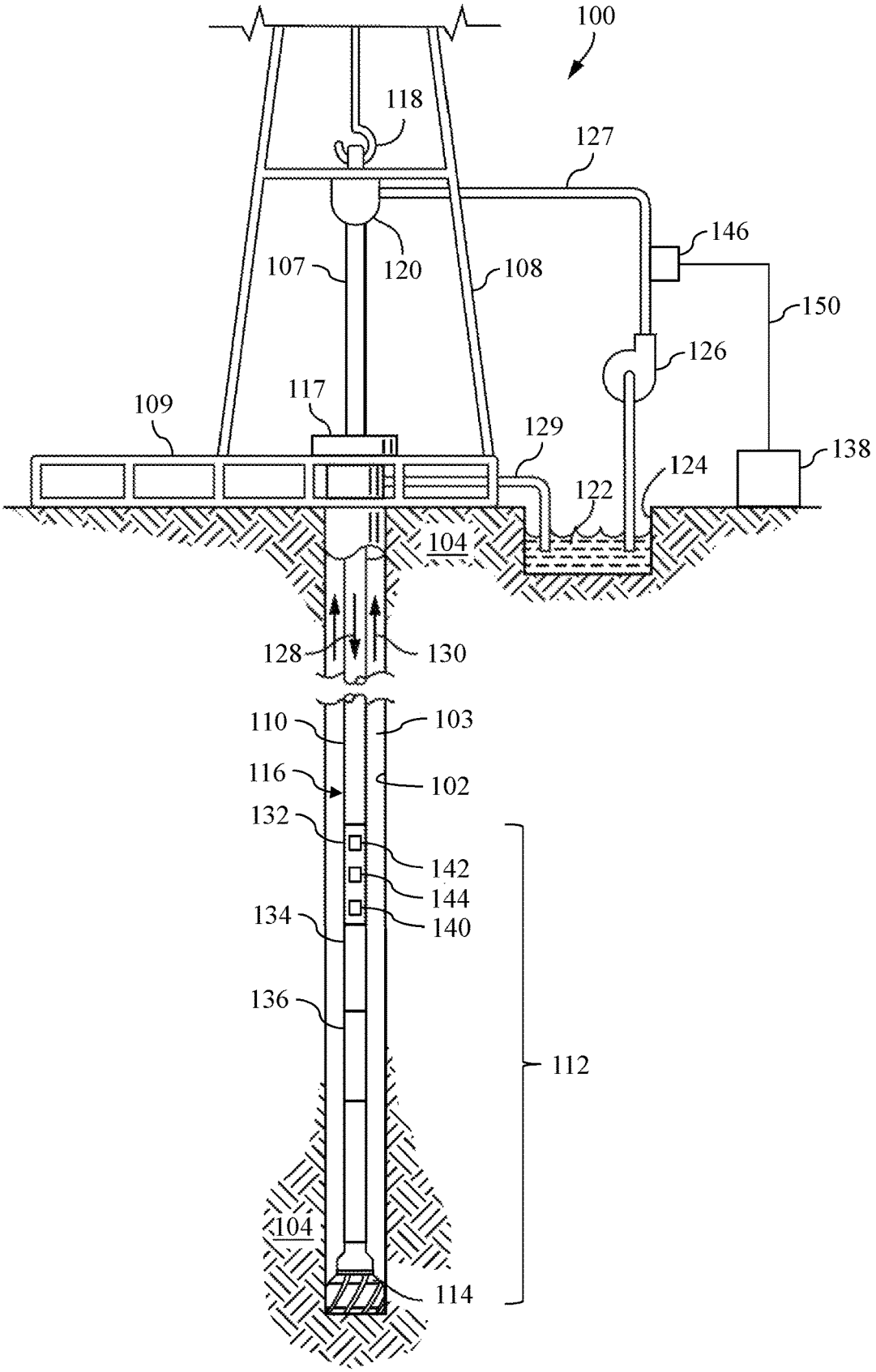
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a wellsite system 100 according to one or more aspects of the present disclosure. The wellsite system 100 (e.g., a drilling rig) represents an example environment in which one or more aspects described below may be implemented. It is also noted that although the wellsite system 100 is depicted as an onshore implementation, it is understood that the aspects described below are also generally applicable to offshore implementations.

The wellsite system 100 is depicted in relation to a wellbore 102 formed in a subterranean formation 104 by rotary and/or directional drilling. The wellsite system 100 includes a platform, rig, derrick, and/or other wellsite structure 108 positioned over the wellbore 102. A bottom hole assembly (BHA) 112 is suspended from the wellsite structure 108 within the wellbore 102 via a conveyance means 110. The conveyance means 110 may comprise drill pipe, wired drill pipe (WDP), tough logging condition (TLC) pipe, coiled tubing, and/or other means of conveying the BHA 112 within the wellbore 102.

The BHA 112 may include or be coupled to a drill bit 114 at its lower end. Rotation of the drill bit 114 advances the BHA 112 into the formation 104 to form the wellbore 102. The conveyance means 110 and the BHA 112 may form a drill string 116. A kelly 107 connected to the upper end of the conveyance means 110 may be rotated by a rotary table 117 on a rig floor 109. The kelly 107, and thus the conveyance means 110, may be suspended from the wellsite structure 108 via a hook 118 and fluid swivel 120 in a manner permitting rotation of the kelly 107 and the conveyance means 110 relative to the hook 118. However, a powered swivel, such a top drive (not shown), may be utilized instead of or in addition to the kelly 107 and rotary table 117.

The wellsite system 100 may also comprise a pit, tank, and/or other surface container 124 containing drilling fluid 122 (i.e., drilling mud). A pump unit 126 may deliver the drilling fluid 122 to the interior of the conveyance means 110, such as via a fluid conduit 127 extending between the pump unit 126 and the swivel 120, internal flow passages (not shown) of the fluid swivel 120, and the interior of the kelly 107, thus facilitating flow of the drilling fluid 122 downhole through the conveyance means 110, as indicated by directional arrow 128. The drilling fluid 122 exits ports (not shown) in the drill bit 114 and then circulates uphole through an annulus 103 defined between the outside of the conveyance means 110 and the wall of the wellbore 102, as indicated by direction arrows 130. In this manner, the drilling fluid 122 lubricates the drill bit 114 and carries formation cuttings up to the surface, where the drilling fluid 122 is returned to the surface container 124 via a fluid return line 129 for recirculation. Although the wellsite system 100 is shown having one pump unit 126, it is to be understood that the drilling fluid may be pumped by two, three, or more pump units 126. The fluid conduit 127, the fluid swivel 120, the kelly 107, and the drill string 116 collectively form a pressurized drilling fluid delivery line, and the pump unit 126 and the pressurized drilling fluid delivery line collectively form a pressurized drilling fluid delivery system.

The wellsite system 100 may further include a surface controller 138 (e.g., a computer, a processing device. etc.) for monitoring and controlling portions of the wellsite system 100, such as the BHA 112 and the pump unit 126. The surface controller 138 may comprise interfaces for receiving commands from a human operator and communicating with the BHA 112 via mud-pulse telemetry. The surface controller 138 may store executable computer program code and/or computer readable instructions, including for implementing one or more aspects of the methods described herein.

The BHA 112 includes various numbers and/or types of downhole tools 132, 134, 136. One or more of the downhole tools 132, 134, 136 may be or comprise an acoustic tool, a density tool, a directional drilling tool, an electromagnetic (EM) tool, a formation testing tool, a formation sampling tool, a gravity tool, a monitoring tool, a neutron tool, a nuclear tool, a photoelectric factor tool, a porosity tool, a reservoir characterization tool, a resistivity tool, a sampling-while-drilling (SWD) tool, a seismic tool, a surveying tool, and/or a tough logging condition (TLC) tool, although other downhole tools are also within the scope of the present disclosure. One or more of the downhole tools 132, 134, 136 may also be implemented as an MWD or logging-while-drilling (LWD) tool for the acquisition and/or transmission of downhole data to the surface controller 138.

For example, the downhole tool 132 may be or comprise an MWD or LWD tool comprising a sensor package 140 operable for the acquisition of measurement data pertaining to the BHA 112, the wellbore 102, and/or the formation 104. The downhole tool 132 and/or another portion of the BHA 112 may also comprise a downhole telemetry device 142 operable for communication with the surface controller 138. The downhole tool 132 and/or another portion of the BHA 112 may also comprise a downhole controller 144 (e.g., a computer, a processing device. etc.) operable to receive, process, and/or store information received from the sensor package 140 and/or other portions of the BHA 112. The downhole controller 144 may be further operable to control the sensor package 140, the telemetry device 142, and/or other portions of the BHA 112. The downhole controller 144 may store executable computer program code and/or computer readable instructions, including for implementing one or more aspects of the methods described herein.

Telemetry between the surface controller 138 and the BHA 112 (e.g., the downhole controller 144) may be via mud-pulse telemetry (i.e., pressure pulses) sent through the drilling fluid 122 flowing within the pressurized drilling fluid delivery line. For example, the downhole telemetry device 142 may comprise a modulator selectively operable to cause pressure changes (e.g., pulsations, fluctuations) in the drilling fluid flowing within the conveyance means 110, the fluid swivel 120, and the fluid delivery line 127. During operations, the telemetry device 142 may modulate the pressure of the drilling fluid 122 within the pressurized drilling fluid delivery line to transmit data (hereinafter "uplink mud-pulse telemetry data") received from the downhole controller 144, the sensor package 140, and/or other portions of the BHA 112 to the surface controller 138 in the form of pressure pulses. The modulated pressure pulses travel uphole through the pressurized drilling fluid delivery line, and are detected by an uphole telemetry device 146. The uphole telemetry device 146 may comprise a pressure transducer or sensor in contact with the drilling fluid 122 being pumped downhole. The uphole telemetry device 146 may, thus, be disposed along or in connection with the fluid delivery line 127, the swivel 120, and/or another conduit or device transferring or in contact with the drilling fluid 122. The pressure sensor may be communicatively connected to the surface controller 138 via wired or wireless communication means 150. The surface controller 138 may be operable to interpret the pressure pulses detected by the pressure sensor to reconstruct the uplink mud-pulse telemetry data transmitted by the downhole telemetry device 142.

The uphole telemetry device 146 may be operable to communicate with the BHA 112 via mud-pulse telemetry. The uphole telemetry device 146 may comprise a modulator selectively operable to cause pressure pulses in the drilling fluid flowing within the pressurized drilling fluid delivery line. For example, during operations, the uphole telemetry device 146 may modulate the pressure of the drilling fluid 122 within the pressurized drilling fluid delivery line to transmit data (hereinafter "downlink mud-pulse telemetry data") received from the surface controller 138 to the downhole controller 144 and/or another portion of the BHA 112 in the form of pressure pulses. Such pressure pulses travel downhole through the drilling fluid 122 within the pressurized drilling fluid delivery line, and are detected by the downhole telemetry device 142. The downhole telemetry device 142 may comprise a pressure transducer or sensor in contact with the drilling fluid pumped through the BHA 112. The pressure sensor may be communicatively connected to the downhole controller 144. The downhole controller 144 may be operable to interpret the pressure pulses detected by the pressure sensor to reconstruct the downlink mud-pulse telemetry data transmitted by the uphole telemetry device 146.

Figure 2:
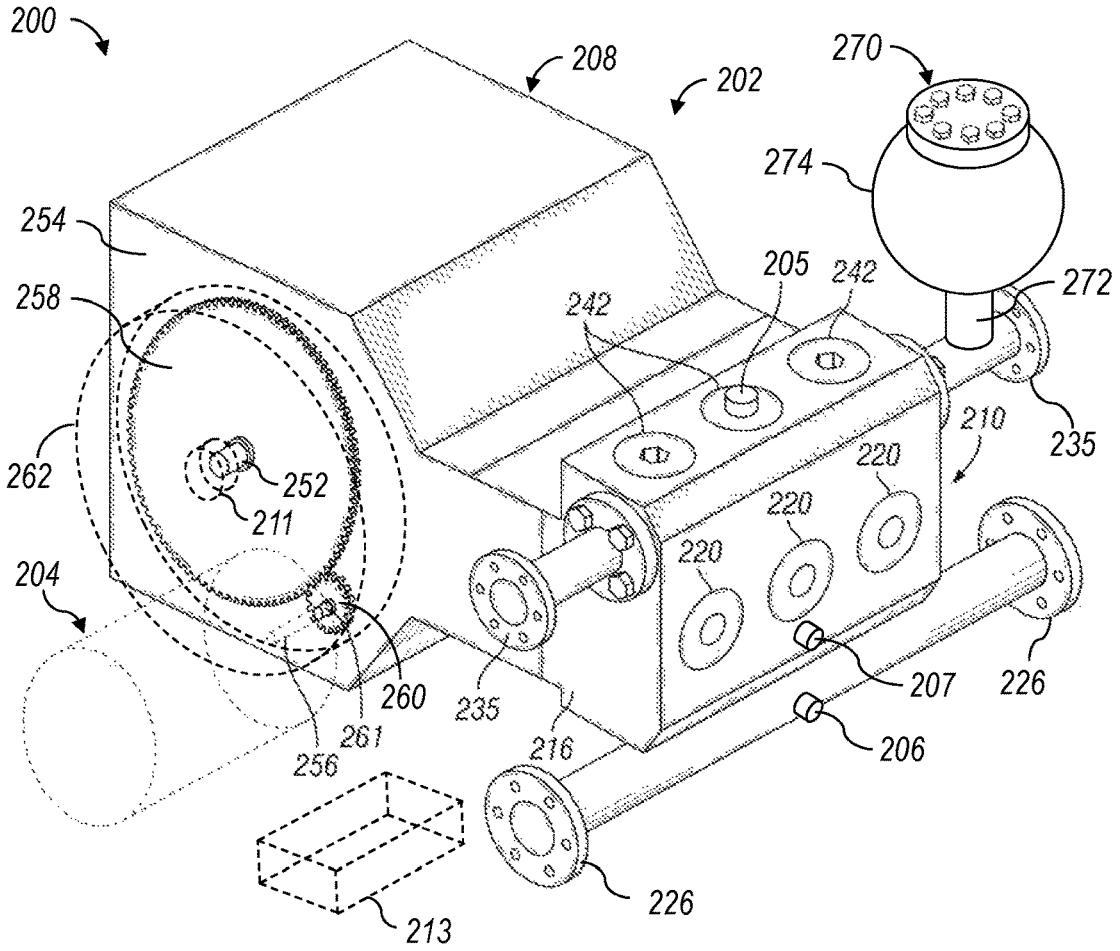
FIG. 2 is a perspective view of an example implementation of apparatus according to one or more aspects of the present disclosure.
Figure 3:
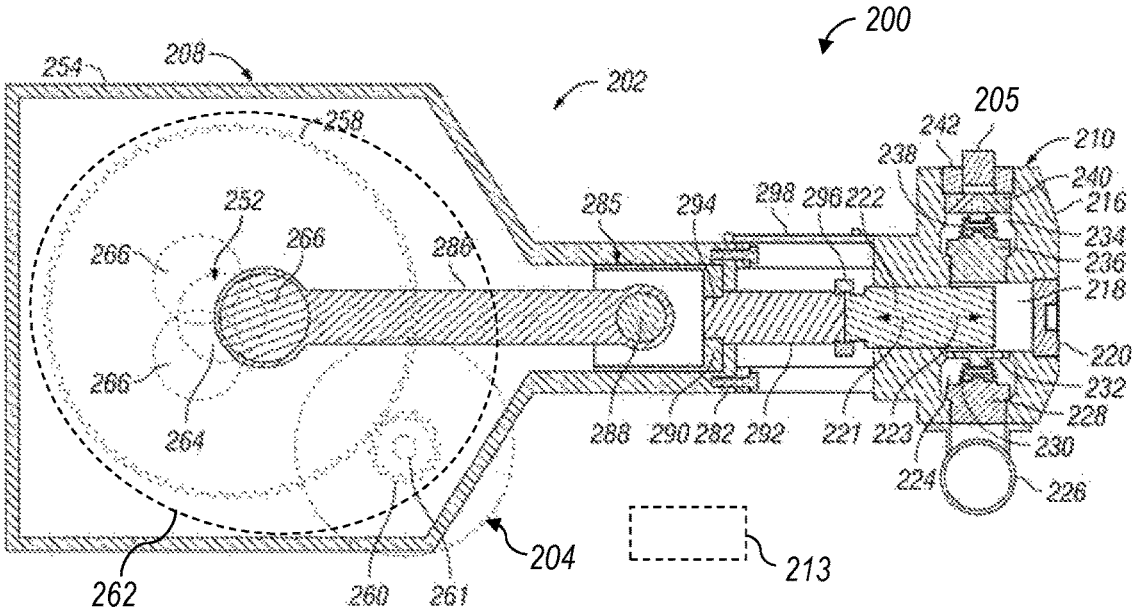
FIG. 3 is a side sectional view of the apparatus shown in FIG. 2.

FIG. 2 is a perspective schematic view of at least a portion of an example implementation of the pump unit 126 shown in FIG. 1 according to one or more aspects of the present disclosure, and designated in FIG. 2 by reference numeral 200. FIG. 3 is a side sectional view of a portion of the pump unit 200 shown in FIG. 2. Portions of the pump unit 200 shown in FIGS. 2 and 3 are shown in phantom lines, such as to prevent obstructing from view other portions of the pump unit 200. The following description refers to FIGS. 1-3, collectively.

The pump unit 200 comprises a fluid pump 202 operatively coupled with and actuated by a prime mover 204. The pump 202 includes a power section 208 and a fluid section 210. The fluid section 210 may comprise a pump housing 216 having a plurality of fluid chambers 218. One end of each fluid chamber 218 may be plugged by a cover plate 220, such as may be threadedly engaged with the pump housing 216 and an opposite end of each fluid chamber 218 may contain a reciprocating member 222 slidably disposed therein and operable to displace the fluid within the corresponding fluid chamber 218. Although the reciprocating member 222 is depicted as a plunger, the reciprocating member 222 may also be implemented as a piston, diaphragm, or another reciprocating fluid displacing member.

Each fluid chamber 218 is fluidly connected with a corresponding one of a plurality of fluid inlet cavities 224 each adapted for communicating fluid from fluid inlets 226 into a corresponding fluid chamber 218. The fluid inlets 226 may be fluidly connected with a source of fluid (e.g., drilling fluid) via a suction conduit. Each fluid inlet cavity 224 may contain an inlet valve 228 operable to control fluid flow from the fluid inlets 226 into the fluid chamber 218. Each inlet valve 228 may be biased toward a closed flow position by a first spring or another biasing member 230, which may be held in place by an inlet valve stop 232. Each inlet valve 228 may be actuated to an open flow position by a predetermined differential pressure between the corresponding fluid inlet cavity 224 and the fluid inlets 226.

Each fluid chamber 218 is also fluidly connected with a fluid outlet cavity 234 extending through the pump housing 216 transverse to the reciprocating members 222. The fluid outlet cavity 234 is adapted for communicating pressurized fluid from each fluid chamber 218 into one or more fluid outlets 235 fluidly connected at one or both ends of the fluid outlet cavity 234. The fluid outlets 235 may be in fluid communication with a corresponding fluid conduit, such as the fluid conduit 127. The fluid section 210 also contains a plurality of outlet valves 236 each operable to control fluid flow from a corresponding fluid chamber 218 into the fluid outlet cavity 234. Each outlet valve 236 may be biased toward a closed flow position by a spring or another biasing member 238, which may be held in place by an outlet valve stop 240. Each outlet valve 236 may be actuated to an open flow position by a predetermined differential pressure between the corresponding fluid chamber 218 and the fluid outlet cavity 234. The fluid outlet cavity 234 may be plugged by cover plates 242, such as may be threadedly engaged with the pump housing 216.

During pumping operations, portions of the power section 208 of the pump unit 200 rotate in a manner that generates a reciprocating linear motion to move the reciprocating members 222 longitudinally within the corresponding fluid chambers 218, thereby alternatingly drawing and displacing the fluid within the fluid chambers 218. With regard to each reciprocating member 222, while the reciprocating member 222 moves out of the fluid chamber 218, as indicated by arrow 221, the pressure of the fluid inside the corresponding fluid chamber 218 decreases, thus creating a differential pressure across the corresponding fluid inlet valve 228. The pressure differential operates to compress the biasing member 230, thus actuating the fluid inlet valve 228 to an open flow position to permit the fluid from the fluid inlets 226 to enter the corresponding fluid inlet cavity 224. The fluid then enters the fluid chamber 218 while the reciprocating member 222 continues to move longitudinally out of the fluid chamber 218 until the pressure difference between the fluid inside the fluid chamber 218 and the fluid at the fluid inlets 226 is low enough to permit the biasing member 230 to actuate the fluid inlet valve 228 to the closed flow position. When the reciprocating member 222 begins to move longitudinally back into the fluid chamber 218, as indicated by arrow 223, the pressure of the fluid inside of fluid chamber 218 begins to increase. The fluid pressure inside the fluid chamber 218 continues to increase while the reciprocating member 222 continues to move into the fluid chamber 218 until the pressure of the fluid inside the fluid chamber 218 is high enough to overcome the pressure of the fluid inside the fluid outlet cavity 234 and compress the biasing member 238, thus actuating the fluid outlet valve 236 to the open flow position and permitting the pressurized fluid to move into the fluid outlet cavity 234, the fluid outlets 235, and the corresponding fluid conduit 144.

The fluid flow rate generated by the pump unit 200 may depend on the physical size of the reciprocating members 222 and fluid chambers 218, as well as the pump unit operating speed, which may be defined by the speed or rate at which the reciprocating members 222 cycle or move within the fluid chambers 218. The pumping speed, such as the speed or the rate at which the reciprocating members 222 move, may be related to the rotational speed of the power section 208 and/or the prime mover 204. Accordingly, the fluid flow rate generated by the pump unit 200 may be controlled by controlling the rotational speed of the power section 208 and/or the prime mover 204.

The prime mover 204 may comprise an engine, such as a gasoline engine or a diesel engine, an electric motor, such as a synchronous or asynchronous electric motor, including a synchronous permanent magnet motor, a hydraulic motor, or another prime mover operable to drive or otherwise rotate a drive shaft 252 (i.e., main pump shaft) of the power section 208. The drive shaft 252 may be enclosed and maintained in position by a power section housing 254. To prevent relative rotation between the power section housing 254 and the prime mover 204, the power section housing 254 and prime mover 204 may be fixedly coupled together or to a common base, such as a mobile trailer.

The prime mover 204 may comprise a rotatable output shaft 256 operatively connected with the drive shaft 252 via a gear train or transmission 262, which may comprise at a spur gear 258 coupled with the drive shaft 252 and a corresponding pinion gear 260 coupled with a support shaft 261. The output shaft 256 and the support shaft 261 may be coupled, such as may facilitate transfer of torque from the prime mover 204 to the support shaft 261, the pinion gear 260, the spur gear 258, and the drive shaft 252. For clarity, FIGS. 2 and 3 show the transmission 262 comprising a single spur gear 258 engaging a single pinion gear 260, however, it is to be understood that the transmission 262 comprises a plurality of corresponding sets of gears, such as may permit the transmission 262 to be shifted between different gear sets (i.e., combinations) to control the operating speed of the drive shaft 252 and torque transferred to the drive shaft 252. Accordingly, the transmission 262 may be shifted between different gear sets ("gears") to vary the pumping speed and torque of the power section 208 to vary the fluid flow rate and maximum fluid pressure generated by the fluid section 210 of the pump unit 200. The transmission 262 may also comprise a torque converter (not shown) operable to selectively connect ("lock-up") the prime mover 204 with the transmission 262 and permit slippage ("unlock") between the prime mover 204 and the transmission 262. The torque converter and the gears of the transmission 262 may be shifted manually by a human wellsite operator or remotely via a gear shifter, which may be incorporated as part of a pump unit controller 213. The gear shifter may receive control signals from a controller (e.g., the surface controller 138) and output a corresponding electrical or mechanical control signal to shift the gear of the transmission 262 and lock-up the transmission, such as to control the fluid flow rate and the operating pressure of the pump unit 200.

The drive shaft 252 may be implemented as a crankshaft comprising a plurality of axial journals 264 and offset journals 266. The axial journals 264 may extend along a central axis of rotation of the drive shaft 252, and the offset journals 266 may be offset from the central axis of rotation by a distance and spaced 120 degrees apart with respect to the axial journals 264. The drive shaft 252 may be supported in position within the power section 208 by the power section housing 254, wherein two of the axial journals 264 may extend through opposing openings in the power section housing 254.

The power section 208 and the fluid section 210 may be coupled or otherwise connected together. For example, the pump housing 216 may be fastened with the power section housing 254 by a plurality of threaded fasteners 282. The pump 202 may further comprise an access door 298, which may facilitate access to portions of the pump 202 located between the power section 208 and the fluid section 210, such as during assembly and/or maintenance of the pump 202.

A plurality of crosshead mechanisms 285 may be utilized to transform and transmit the rotational motion of the drive shaft 252 to a reciprocating linear motion of the reciprocating members 222. For example, each crosshead mechanism 285 may comprise a connecting rod 286 pivotally coupled with a corresponding offset journal 266 at one end and with a pin 288 of a crosshead 290 at an opposing end. During pumping operations, walls and/or interior portions of the power section housing 254 may guide each crosshead 290, such as may prevent or inhibit lateral motion of each crosshead 290. Each crosshead mechanism 285 may further comprise a piston rod 292 coupling the crosshead 290 with the reciprocating member 222. The piston rod 292 may be coupled with the crosshead 290 via a threaded connection 294 and with the reciprocating member 222 via a flexible connection 296.

The pump unit 200 may comprise a pressure pulsation dampener 270, which may be fluidly connected with or along one or both of the fluid outlets 235 of the pump 202 to dissipate or otherwise reduce magnitude (i.e., amplitude) of the pressure pulsations (i.e., fluctuations) within the drilling fluid discharged from the pump 202. The pulsation dampener 270 may comprise a pressure vessel 274 having an internal chamber containing a gas-charged bladder (not shown) and fluid port 272 through which the internal chamber may receive the fluid (e.g., drilling fluid) being discharged via the fluid outlets 235.

The pump unit 200 may comprise one or more pressure sensors 205 disposed in association with the fluid section 210 in a manner permitting sensing of fluid pressure at the fluid outlets 235. For example, the pressure sensor 205 may extend through one or more of the cover plates 242 or other portions of the corresponding pump housing 216 to monitor pressure within the fluid outlet cavity 234 and, thus, the fluid outlets 235. The pump unit 200 may comprise one or more pressure sensors 206 disposed in association with the fluid section 210 in a manner permitting sensing of fluid pressure at the fluid inlets 226. For example, the pressure sensor 206 may be connected along a pipe forming the fluid inlets 226 to monitor fluid pressure at the fluid inlets 226.

The pump unit 200 may further comprise one of more vibration sensors 207 (e.g., accelerometers, strain gauge sensors, etc.) installed in association with the pump unit 200 in a manner permitting monitoring of vibrations experienced by the pump unit 200 during pumping operations. A vibration sensor 207 may be coupled with the fluid section 210 such as may permit monitoring of vibrations caused by the oscillating movement of the reciprocating members 222. The vibration sensor 207 may be operable to generate signals or information indicative of amplitude, phase, and/or frequency of the vibrations experienced by the pump unit 200, which in turn may be indicative of phase and frequency of pumping operations.

The pump unit 200 may further comprise one or more rotational position and speed ("rotary") sensors 211 operable to generate a signal or information indicative of rotational or otherwise operational position (i.e., phase) of the pump unit 200, and rotational or otherwise operational speed (i.e., frequency) of the pump unit 200. For example, one or more of the rotary sensors 211 may be operable to convert angular position or motion of the drive shaft 252 or another rotating portion of the power section 208 to an electrical signal indicative of operational position and pumping speed of the pump unit 200. The rotary sensor 211 may be mounted in association with an external portion of the drive shaft 252 or other rotating members of the power section 208. The rotary sensor 211 may also or instead be mounted in association of the prime mover 204 to monitor the rotational position and/or rotational speed of the prime mover 204, which may be utilized to determine the operational position and pumping speed of the pump unit 200. The rotary sensor 211 may be or comprise an encoder, a rotary potentiometer, a synchro, a resolver, and/or an RVDT, among other examples.

The pump unit controller 213 may further include prime mover power and/or control components, such as a variable frequency drive (VFD) and/or an engine throttle control, which may be utilized to facilitate control of the prime mover 204. The VFD and/or throttle control may be connected with or otherwise in communication with the prime mover 204 via mechanical and/or electrical communication means (not shown). The pump unit controller 213 may include the VFD in implementations in which the prime mover 204 is or comprises an electric motor and the pump unit controller 213 may include the engine throttle control in implementations in which the prime mover 204 is or comprises an engine. For example, the VFD may receive control signals from a surface controller (e.g., the surface controller 138) and output corresponding electrical power to control the speed and the torque output of the prime mover 204 and, thus, control the pumping speed and fluid flow rate of the pump unit 200, as well as the maximum pressure generated by the pump unit 200. The throttle control may receive control signals from the surface controller and output a corresponding electrical or mechanical throttle control signal to control the speed of the prime mover 204 to control the pumping speed and, thus, the fluid flow rate generated by the pump unit 200. Although the pump unit controller 213 is shown located near or in association with the prime mover 204, the pump unit controller 213 may be located or disposed at a distance from the prime mover 204. For example, the pump unit controller 213 may be communicatively connected with the surface controller and/or located within or form a portion of a wellsite control center (e.g., control cabin, control trailer, etc.).

The surface controller may be further operable to monitor and control various operational parameters of the pump unit 200. The surface controller may be in communication with the various sensors of the pump unit 200 including the pressure sensors 205, 206, the vibration sensor 207, and the rotary sensor 211 to facilitate monitoring of the pump unit 200. The surface controller may be in communication with the transmission 262 via the gear shifter of the pump unit controller 213, such as to control the operating speed and phase of the pump unit 200, as well as flow rate and pressure generated by the pump unit 200 to facilitate control of the pump unit 200. The surface controller may also be in communication with the prime mover 204 via the VFD of the pump unit controller 213 if the prime mover 204 is an electric motor or via the throttle control of the pump unit controller 213 if the prime mover 204 is an engine, such as may permit the surface controller to activate, deactivate, and control the operating speed and phase of the pump unit 200, as well as to control the flow rate and pressure generated by the pump unit 200.

Although FIGS. 2 and 3 show the pump unit 200 comprising a triplex reciprocating pump 202, which has three fluid chambers 218 and three reciprocating members 222, implementations within the scope of the present disclosure may include the pump 202 as or comprising a quintuplex reciprocating pump having five fluid chambers 218 and five reciprocating members 222, or a pump having other quantities of fluid chambers 218 and reciprocating members 222. It is further noted that the pump 202 described above and shown in FIGS. 2 and 3 is merely an example, and that other pumps, such as diaphragm pumps, gear pumps, external circumferential pumps, internal circumferential pumps, lobe pumps, and other positive displacement pumps, are also within the scope of the present disclosure.

The present disclosure is further directed to systems and methods for actively reducing mud-pump pressure pulsations within drilling fluid (i.e., mud) being pumped downhole via a pressurized drilling fluid delivery line. A system within the scope of the present disclosure may be operable to measure the mud-pump pressure pulsations, and through a closed control loop, feed the measurements to an active pressure pulsation dampener and a pump synchronization system, resulting in real-time mud-pump synchronization coupled with real-time active pulsation (i.e., fluid pressure noise) dampening, which collectively smooth out pressure profile of the drilling fluid being pumped downhole, such as during drilling operations. A smoother drilling fluid pressure profile can improve mud-pulse telemetry and facilitate longer operational life of pumping equipment.

Example systems and methods may include taking pressure measurements at a mud pump and feeding such measurements into a controller or another processing device. The controller may then output control commands to various actuators to reduce pressure pulsations. The actuators execute the control commands resulting in reduced pressure pulsations. Pressure measurements are continuously taken and fed to the controller, thereby continuously repeating the control cycle.

Active drilling fluid pressure pulsation dampening may be operable to clean or smooth out pressure profile of the drilling fluid being pumped, thereby facilitating improved mud-pulse telemetry. A cleaner pressure profile may permit a higher information bandwidth between wellsite surface and downhole tools. Active pressure pulsation dampening may permit reduction or replacement of bulky surface pressure pulsation dampeners (e.g., pressure pulsation dampener 270 shown in FIG. 2). Pressure and other monitoring of the pressurized drilling fluid delivery system may also be indicative of health of fluid conduits, valves, mud pumps, pulsation dampeners, and other equipment of the pressurized drilling fluid delivery system.

Figure 4:
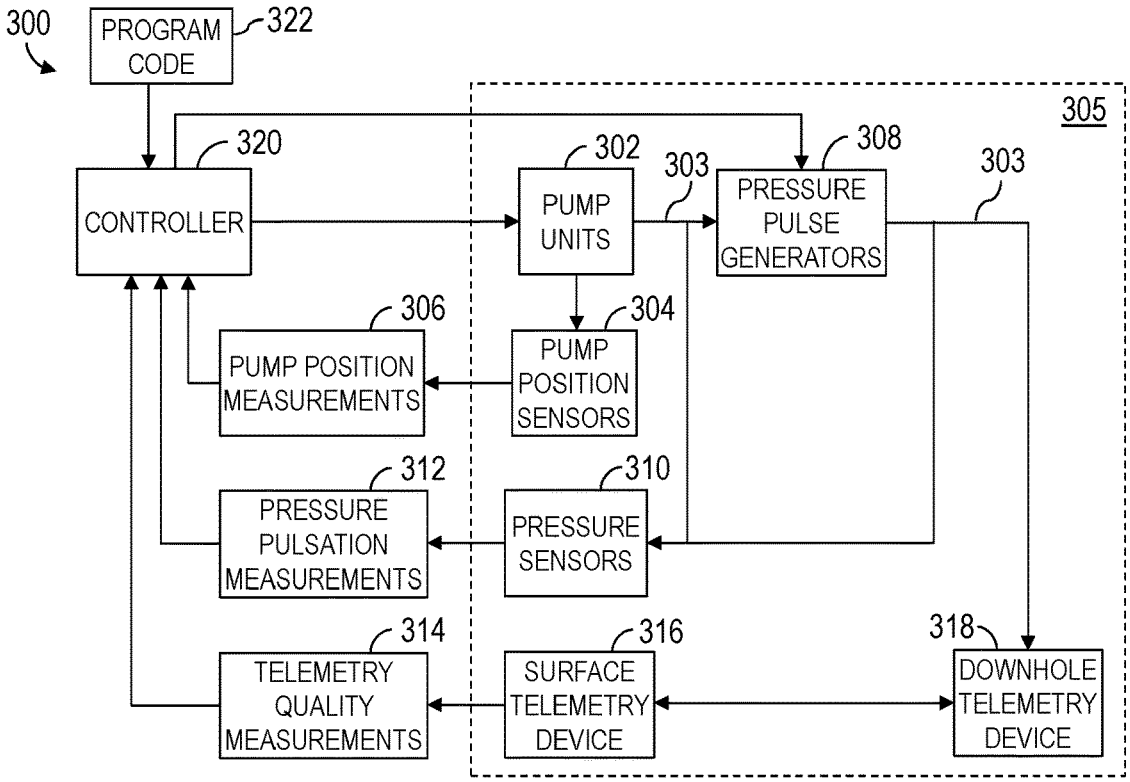
FIG. 4 is a schematic view of at least a portion of an example implementation of apparatus according to one or more aspects of the present disclosure.

FIG. 4 is a schematic view of at least a portion of an example implementation of a drilling fluid pressure pulsation dampening system 300 operable to dissipate or otherwise reduce magnitude (i.e., amplitude) of the pressure pulsations (i.e., spikes, fluctuations) within pressurized drilling fluid pumped by a plurality of reciprocating pump units, according to one or more aspects of the present disclosure. The dampening system 300 may comprise, be fluidly connected with, or otherwise be utilized with a pressurized drilling fluid delivery system, such as comprising one or more surface mud pump units 302 and a pressurized drilling fluid delivery line 303, such as extending between the pump units 302 and a drill bit located within a wellbore. The pressurized drilling fluid delivery line 303 may comprise, for example, pressure line(s) or conduit(s) transferring pressurized drilling fluid from the pump units 302, a fluid swivel, a kelly, and a drill string. The dampening system 300 may be operable to measure pressure pulsations of the drilling fluid discharged by the pump units 302 and actively in real-time (i.e., on-the-fly) minimize magnitude of such pressure pulsations within the pumped drilling fluid. The dampening system 300 may utilize pump unit operational synchronization and inline pressure pulse cancellation to optimize the pressure profile along the drilling fluid line 303 to facilitate optimum telemetry quality between uphole and downhole equipment. The dampening system 300 may utilize a plurality of actuators operable to dampen pressure pulsations transmitted along the drilling fluid line 303 and a plurality of sensors operable to generate feedback information utilized to control the actuators.

The dampening system 300 may comprise a pump position sensor 304 disposed in association with each of the pump units 302. Each pump position sensor 304 (i.e., transducer) may be operable to generate signals or information indicative of operating state, phase, or position measurements 306 of a corresponding one of the pump units 302. A pump position sensor 304 may be or comprise an encoder disposed in association with a drive shaft of the corresponding pump unit 302, such as may permit pump operating position 306 to be measured by measuring angular position of the drive shaft. A position sensor 304 may also or instead be or comprise a pressure sensor disposed at pump inlet and/or outlet. Pressure signals generated by each pressure sensor may be indicative of the pump operating position 306 by measuring pressure pulsation timing. The angular position of the drive shaft may be interpolated from the pressure fluctuation information. A position sensor 304 may also or instead be or comprise a vibration or acceleration sensor. When a pump unit 302 vibrates, the timing of the vibration waveform can be indicative of pump operating position 306 (e.g., shaft angular position), such as by analyzing location of vibration peaks and dips (i.e., valleys) with respect to time.

The dampening system 300 may further comprise one or more pressure pulse generators 308 fluidly connected to or along the drilling fluid line 303 and operable to input a pressure pulse into the drilling fluid line 303. The pressure pulse generator 308 may be operable to generate the pressure pulse by injecting a fluid (e.g., drilling fluid) into the drilling fluid line 303 for a predetermined period of time (i.e., wavelength), at a predetermined pressure (i.e., magnitude), and at a predetermined rate (i.e., frequency). The pressure pulse generator 308 may be hydraulically, pneumatically, or otherwise mechanically powered. The pressure pulse generator 308 may introduce pulsations that condition the in-line pressure to reach pressure signal quality targets. This may be an "anti-noise" waveform operable to dampen the pressure pulsations within the drilling fluid line 303. The inputted pressure pulses can be controlled in their frequency, length, and/or magnitude. The pressure pulse generator 308 may be connected to a fluid outlet of each pump unit 302. A pressure pulse generator 308 may also or instead be connected at a fluid inlet or in a fluid chamber of each pump unit 302. A pressure pulse generator 308 may be connected upstream or downstream of a pulsation dampener of each pump unit 302, and/or upstream or downstream of an inlet and/or outlet manifold. Single or multiple pressure generators 308 may be utilized.

The dampening system 300 may also comprise one or more pressure sensors 310 operable to generate signals or information indicative of pressure pulsation measurements 312 of the fluid being pressurized by the pump units 302. The pressure sensors 310 may be connected to or at the fluid inlets, outlets, and/or pressure chambers of the pump units 302. The pressure sensors 310 may be connected upstream and/or downstream of the pulsation dampener of each pump unit 302. The pressure sensors 310 may be connected upstream and/or downstream of inlet or outlet manifolds of the pump units 302. One or more of the pressure sensors 310 may be connected along the drilling fluid line 303 upstream and/or downstream of the pressure pulse generator 308. The pressure sensors 310 may be or comprise digital signal pressure transducers (DSPT).

The dampening system 300 may also utilize measurements of mud-pulse telemetry quality between a telemetry device of a downhole tool and a telemetry device of the surface equipment. For example, the uphole and downhole telemetry devices may perform telemetry self-diagnostics, generating mud-pulse telemetry quality measurements 314. For example, a downhole telemetry device 318 of a downhole tool located along (e.g., at bottom end) the drilling fluid line 303, can send to a surface telemetry device 316 an information stream designed to test telemetry quality through the fluid line 303, which is affected by the pressure profile of the fluid being pumped along the drilling fluid line 303. The surface telemetry device 316 may also or instead send an information stream to the downhole telemetry device 318, which upon receiving it, will send an information report on its receiving condition back to the surface telemetry device 316. Such information stream, referred to hereinafter as telemetry quality measurements 314 (i.e., telemetry self-diagnostics signal), can be outputted by the surface telemetry device 316 or another piece of surface equipment and be utilized by the dampening system 300 as a feedback measurement to monitor pressure profile of the drilling fluid being pumped downhole along the drilling fluid line 303.

The pump units 302, the pressurized drilling fluid delivery line 303, the pressure pulse generators 308, the position sensors 304, the pressure sensors 310, and the downhole 318 and surface 316 telemetry devices may collectively form at least a portion of a pressurized drilling fluid delivery system 305. The feedback signals or information 306, 312, 314 may be transmitted to a controller 320 (e.g., computer, programmable logic controller (PLC), etc.), which may receive, process, and transmit corresponding control signals (i.e., command signals) to the pump units 302 and the pressure pulse generators 308, to minimize pressure pulsations (i.e., smooth out or clean the pressure profile) or otherwise control the pressure pulsations within the drilling fluid line 303. The controller 320 may be operable to receive computer program code 322 (e.g., computer executable control commands or instructions), such as for calculating or otherwise determining the control signals to be transmitted to the pump units 302 and the pressure generators 308 based on the feedback signals 306, 312, 314. Accordingly, the dampening system 300 may be a closed-loop system operable to continually monitor and modulate the pressure profile of the drilling fluid being pumped by the pump units 302 based the feedback signals 306, 312, 314.

The controller 320 may analyze the feedback information 306, 312, 314 received and use the program code (e.g., internal logic) to output control signals to adjust operation of the pump units 302 and the pressure generators 308 to reach the intended pressure profile of the drilling fluid being transferred along the drilling fluid line 303. For example, the controller 320 may be operable to use a static pre-determined logic to reach the intended pressure profile and/or use self-learning to explore and understand the effects of control parameters with the intent to reach the intended pressure profile. The controller 320 may also permit a human operator to manually control or adjust operation of the pump units 302 and the pressure generators 308, such as via input devices (not shown) communicatively connected with the controller 320.

The computer program code 322 may cause the controller 320 to receive and process the pressure pulsation measurements 312 to discern and/or detect components that make up the pressure pulsations (i.e., unintended pressure fluctuations or noise) along the drilling fluid line 303. Through the concept of wave cancellation, an anti-noise waveform control signal may be outputted by the controller 320 to the pressure pulse generators 308 to eliminate and/or reduce the detected pressure pulsations within the drilling fluid flowing through the drilling fluid line 303. For example, the controller 320 may cause the pressure generators 308 to introduce into the drilling fluid line 303 pressure pulsations that are out of phase (e.g., 180 degrees apart) from the detected pressure pulsations within the drilling fluid line 303 to eliminate and/or reduce the detected pressure pulsations.

Figure 5:
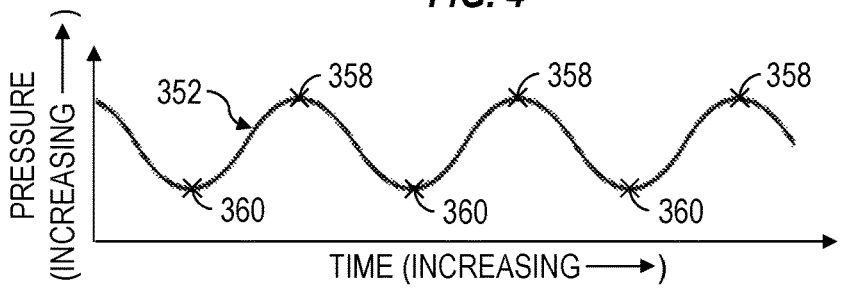
FIGS. 5-12 are graphs related to one or more aspects of the present disclosure.
Figure 6:
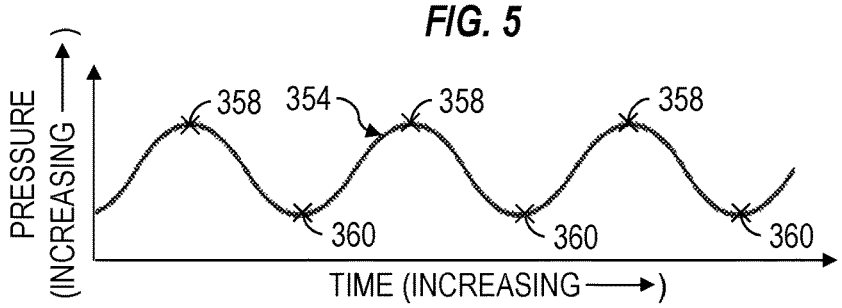
Figure 7:
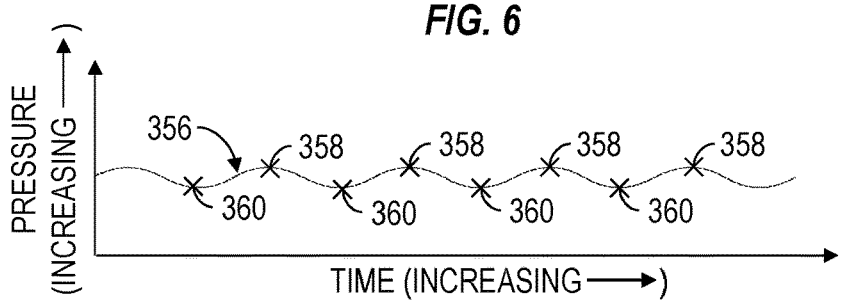
Figure 8:
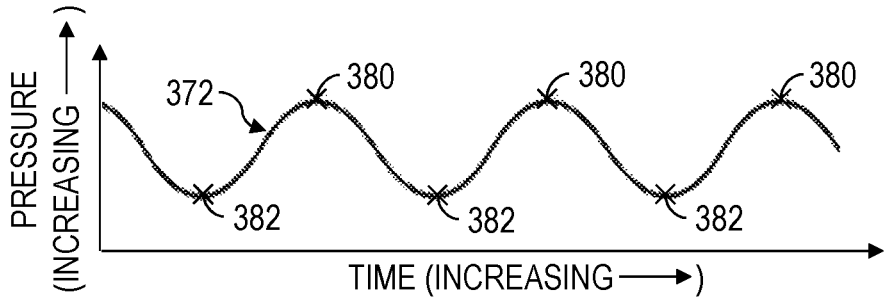
Figure 9:
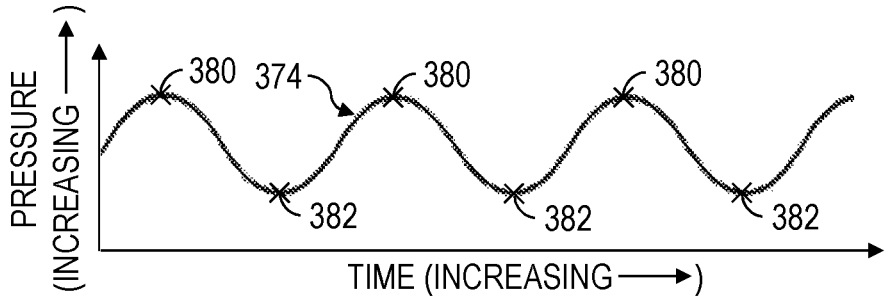
Figure 10:
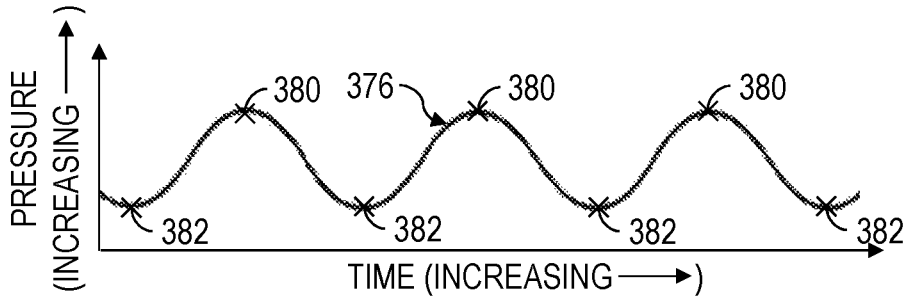
Figure 11:
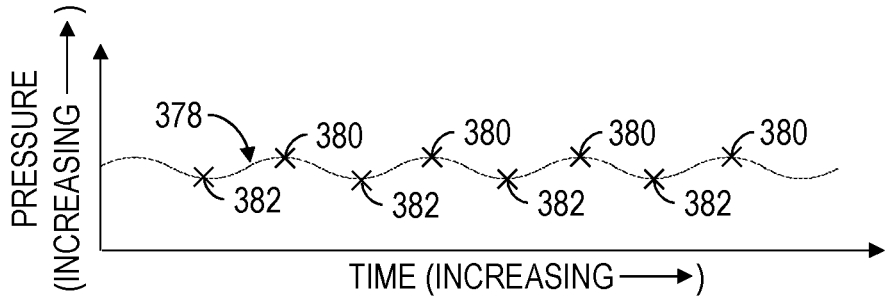

FIGS. 5-7 are graphs showing example pressure profiles 352, 354, 356 of drilling fluid at several locations of the pressurized drilling fluid delivery system 305 according to one or more aspects of the present disclosure. The horizontal axes indicate time and the vertical axes indicate pressure magnitude. The pressure profile 352 is indicative of drilling fluid pressure along the drilling fluid line 303 downstream from the fluid pump units 302 and upstream from pressure generators 308. Pressure profile 354 is indicative of fluid pressure pulses being introduced into the drilling fluid line 303 by a pressure pulse generator 308 downstream from the fluid pump units 302. Pressure profile 352 is indicative of fluid pressure along the drilling fluid line 303 downstream from the pressure generators 308.

As can be seen when comparing the pressure profiles 352, 354, the pressure pulses (i.e., fluctuations, oscillations) imparted by the pressure pulse generator 308 are out of phase with respect to the pressure pulsations outputted by the fluid pump units 302, whereby pressure peaks 358 and dips 360 of the pressure profile 354 occur at different times from pressure peaks 358 and dips 360 of the pressure profile 352. The pressure fluctuations of the pressure profiles 352, 354 are shown out of phase by about 180 degrees. Because the pressure pulse generator 308 introduces pressure pulsations having the pressure profile 354 into the drilling fluid line 303 transferring the drilling fluid having the pressure profile 352, the pressure profiles 352, 354 are combined (e.g., summed additively) within the drilling fluid line 303 to form a combined pressure profile 356 of the drilling fluid being transferred through the pressure line downstream from the pressure pulse generator 308. The resulting pressure fluctuations of the pressure profile 356 comprise smaller magnitudes (i.e., variations between peaks 358 and the dips 360). In other words, the out of phase pressure fluctuations of the individual pressurized fluids at least partially cancel each other out when combined within drilling fluid line 303. Decreasing magnitudes of pressure pulsations may improve telemetry quality via the drilling fluid being transferred downhole along the drilling fluid line 303 and/or reduce pressure related damage to fluid piping, valves, and other equipment of the pressurized drilling fluid delivery system 305 located downstream from the pressure pulse generators 308 caused by prolonged exposure to excessive pressure pulsations.

Although the pressure profile 354 is shown being about 180 degrees out of phase with respect to the pressure profile 352, the pressure pulse generators 308 may be operated such that the pressure profile 354 is out of phase by a different amount (e.g., between about 120 and about 180 degrees), if such phase difference results in higher telemetry quality 314, as indicated by the uphole 316 and/or downhole telemetry devices, than when the pressure profiles 352, 354 are 180 degrees out of phase. In other words, an intent of the pressure pulsation dampening system 300 is to improve telemetry quality 314, which may not depend solely on the resulting variations (i.e., magnitude) between peaks 358 and dips 360 of the resulting pressure profile 356. Thus, the controller 320 may change the phase of the pressure profile 354 generated by the pressure generators 308 to search for, scan for, and/or otherwise determine the phase difference between the pressure profiles 352, 354 that results in smallest variations (i.e., magnitude) between peaks 358 and dips 360 of the resulting pressure profile 356 and/or in optimal telemetry quality.

For example, the controller 320 may execute a "timing sweep" command to fine-tune synchronization between a pressure pulse generator 308 and the pump units 302, thereby changing phase of the pressure profile 354 generated by the pressure pulse generator 308 with respect to the pressure profile 352 generated by the pump units 302. A timing sweep may comprise incrementally advancing or retarding timing of the pressure pulses 354 generated by the pressure pulse generator 308 from its current position with respect to the pressure pulsations 352 generated by the pump unit 302 and then monitoring feedback, such as magnitude of pressure pulsations 312 and/or telemetry quality 314, to determine which timing (i.e., operational phase difference) of the pressure pulse generator 308 yields optimal telemetry quality 314. The phase difference yielding optimal telemetry quality 314 may be implemented or maintained during pumping operations. Because telemetry quality depends on pressure profile smoothness of the drilling fluid being transferred through the drilling fluid line 303, the phase difference yielding the smoothest pressure profile 356 (i.e., smallest pressure pulsations) may also yield optimal telemetry quality 314, as measured by the surface 316 and/or downhole telemetry devices.

The computer program code 322 may also cause the controller 320 to receive and process the pump operational position measurements 306 from the position sensors 304 associated with each of the pump units 302 to detect operational position of each of the pump units 302. For example, the controller 320 may determine the operational position of each pump unit 302 by determining position of a drive shaft (e.g., drive shaft 252 of the pump unit 200 shown in FIG. 2) of each pump unit 302. Through the concept of wave cancellation, the controller 320 may cause the pump units 302 to operate in such manner that pressure oscillations or fluctuations generated by each of the pump units 302 eliminate and/or reduce each other when the streams of drilling fluid pumped by the pump units 302 are combined within the drilling fluid line 303. For example, the controller 320 may cause each pump unit 302 to discharge drilling fluid into the drilling fluid line 303 such that pressure fluctuations of each stream of drilling fluid are out of phase from each other when combined within the drilling fluid line 303.

The controller 320 may then determine if the detected shaft positions of one or more of the pump units 302 result in a pressure profile along the drilling fluid line 303 that is smoother and/or facilitating improved telemetry quality. The controller 320 may cause the pump units 302 to perform timing sweeps, which is to change relative drive shaft positions, and thus relative operational positions, until a smoothest pressure profile is found and/or until optimal telemetry quality is found. For example, the controller 320 may be operable to send a control command to one or more motors driving the pump units 302 to advance or retard timing of the corresponding pump drive shafts until the smoothest pressure profile of the combined drilling fluid being pumped by the pump units 302 through the drilling fluid line 303 is achieved and/or until optimal telemetry quality is achieved. Because telemetry quality depends on pressure profile smoothness of the drilling fluid being transferred through the drilling fluid line 303, the phase difference yielding the smoothest pressure profile (i.e., smallest pressure pulsations) may also yield optimal telemetry quality, as measured by the surface 316 and/or downhole telemetry devices.

The pressure pulsation dampening system 300 may be utilized to control operational position of the pump units 302 instead of or in addition to (e.g., in coordination, in parallel with) the standard shaft synchronization system of a drill rig (e.g., the wellsite system 100 shown in FIG. 1). For example, the dampening system 300 may be utilized to fine-tune, or further improve, the standard rig shaft synchronization system, such as by acting as an advisor (manual or automatic) that feeds information into the standard shaft synchronization system. Alternatively, the standard synchronization system can be used at start-up, then the dampening system 300 can take over. The dampening system 300 may run independently of the standard rig shaft synchronization system, wherein the dampening system 300 does not feed information to the standard shaft synchronization system, but just monitors and reports relative shaft positions during pumping operations.

FIGS. 8-11 are graphs showing example pressure profiles 372, 374, 376, 378 at various locations of the pressurized drilling fluid delivery system 305 shown in FIG. 4 according to one or more aspects of the present disclosure. The horizontal axes indicate time and the vertical axes indicate pressure magnitude. The pressure profiles 372, 374, 376 are each indicative of drilling fluid pressure within a pressure line (or outlet) of a corresponding pump unit 302 before each stream of drilling fluid is combined within the common drilling fluid line 303. Pressure profile 378 is indicative of drilling fluid pressure within the drilling fluid line 303, transferring the combined streams of drilling fluid from the pump units 302 associated with pressure profiles 372, 374, 376. Pressure profile 378 may be indicative of fluid pressure along the drilling fluid line 303 upstream or downstream from the pressure generators 308.

As can be seen when comparing the pressure profiles 372, 374, 376 the pressure fluctuations (i.e., oscillations) imparted by each pump unit 302 are out of phase with respect to each other, wherein pressure peaks 380 and dips 382 of the pressure profiles 372, 374, 376 occur at different times. The pressure fluctuations of the pressure profiles 372, 374, 376 are shown out of phase by about 120 degrees. Because the streams of drilling fluid discharged by each of the pump units 302 are combined within the drilling fluid line 303, the pressure profiles 372, 374, 376 (i.e., the pressure fluctuations) are combined (e.g., summed additively) within the drilling fluid line 303 to form the combined pressure profile 378 of the drilling fluid being transferred through the drilling fluid line 303 downstream from the pump units 302. The resulting pressure fluctuations of the pressure profile 378 comprise smaller pressure variations between peaks 380 and the dips 382. In other words, the out of phase pressure fluctuations of the individual pressurized fluid streams at least partially cancel each other out when combined within drilling fluid line 303. Decreasing magnitudes of pressure pulsations may improve mud-pulse telemetry quality via the drilling fluid being transferred downhole along the drilling fluid line 303 and/or reduce pressure related damage to fluid piping, valves, and other equipment located downstream from the pressure pulse generators 308 caused by prolonged exposure to excessive pressure fluctuations.

Although the pressure profiles 372, 374, 376 are shown being about 120 degrees out of phase with respect to each other, the controller 320 may operate each pump unit 302 such that the pressure profiles 372, 374, 376 are out of phase by a different amount (e.g., between about 90 and about 150 degrees, between about 150 degrees and 210 degrees) if such phase difference results in a smoother pressure profile 378 and/or higher telemetry quality 314, as indicated by the uphole 316 and/or downhole telemetry devices. In other words, an intent of the dampening system 300 is to improve telemetry quality 314, which may not depend solely on the resulting variations (i.e., magnitude) between peaks 380 and dips 382 of the resulting pressure profile 378. Thus, the controller 320 may change the phase of the pressure profiles 372, 374, 376 generated by the pump units 302 to search for, scan for, and/or otherwise determine the phase differences between the pressure profiles 372, 374, 376 that results in smallest variations (i.e., magnitude) between peaks 380 and dips 382 of the resulting pressure profile 378 and/or in optimal telemetry quality.

For example, the controller 320 may execute another timing sweep command to fine-tune synchronization, wherein each pump unit 302 performs a drive shaft timing sweep, thereby changing phase between the shafts of two or more mud pump units 302. A shaft timing sweep may comprise incrementally advancing or retarding timing of each drive shaft from its current position and then monitoring feedback, such as magnitude of pressure pulsations 312 and/or telemetry quality 314, to determine which relative timing (i.e., relative operational phase) of the pump drive shafts or other portions of the pump units yields minimum pressure pulsations 312 and/or optimal telemetry quality 314. The shaft phase differences yielding optimal telemetry quality 314 may be implemented or maintained during pumping operations. Although, the optimal telemetry quality 314 may be determined by sweeping timing of the pump shafts based on sensor information from encoders or other sensors disposed in association with the pump shafts, it is to be understood that sweep command may be performed by changing synchronization of the pump units 302 based on sensor information from other sensors (e.g., pressure sensors, vibrations sensors) indicative of shaft position or otherwise indicative of operational phase or position of the pump units 302.

Figure 12:
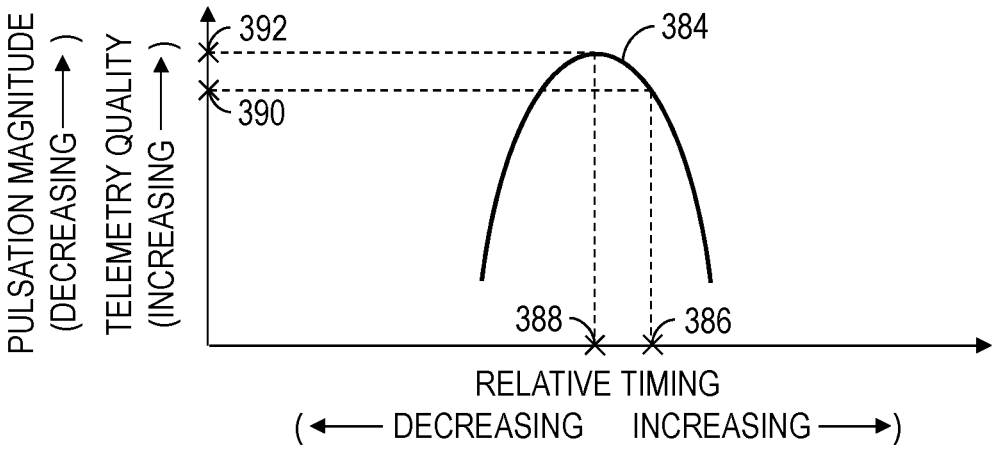

FIG. 12 in a graph showing example relationship 384 between relative operational timing (i.e., phase difference) in operation of selected wellsite equipment, shown along the horizontal axis, and pressure pulsation magnitude/telemetry quality, shown along the vertical axis. For example, as described above with respect to FIGS. 4-7, during a timing sweep, relative timing of operation (and a corresponding pressure profile 354) of a pressure pulse generator 308 may be increased or decreased with respect to timing of operation (and a corresponding pressure profile 352) of the pump units 302 that are pumping drilling fluid along the fluid conduit 303. Similarly, as described above with respect to FIGS. 4 and 8-11, during a timing sweep, relative timing of operation (and corresponding pressure profiles 372, 374, 376) of pump units 302 that are pumping drilling fluid along the fluid conduit 303 may also or instead be increased or decreased. The example relationship 384 indicates that if the relative timing (i.e., phase difference) between the selected wellsite equipment is decreased from a current relative timing 386 to a smaller relative timing 388, pressure pulsation magnitudes, as measured by pressure sensors, and telemetry quality, as measured by upper and/or lower telemetry devices, may increase from a lower level 390 to an optimal level 392. Additional increase or decrease in relative timing may result in increased pressure pulse magnitudes and decreased telemetry quality. The relationship curve 384 shows a pressurized drilling fluid delivery system in which mud-pulse telemetry quality is directly related to the smoothness of a drilling fluid pressure profile. However, in other pressurized drilling fluid delivery systems, the mud-pulse telemetry quality may not be directly related to the smoothness of a drilling fluid pressure profile. In such systems, optimal telemetry quality may be achieved at a less than optimal point along a drilling fluid pressure profile. Furthermore, if a drilling fluid pressure pulsation dampening system within the scope of the present disclosure does not utilize telemetry quality feedback from the telemetry devices, optimal (or near-optimal) mud-pulse telemetry quality may be reached based on just the position sensor feedback and pressure sensor (i.e., pressure pulsation) feedback by finding relative operational timing associated with or resulting in the smallest pressure pulsation magnitudes, such as at relative operational timing 388 associated with or resulting in smallest pressure pulsation magnitudes 392 along the relationship curve 384.

Figure 13:
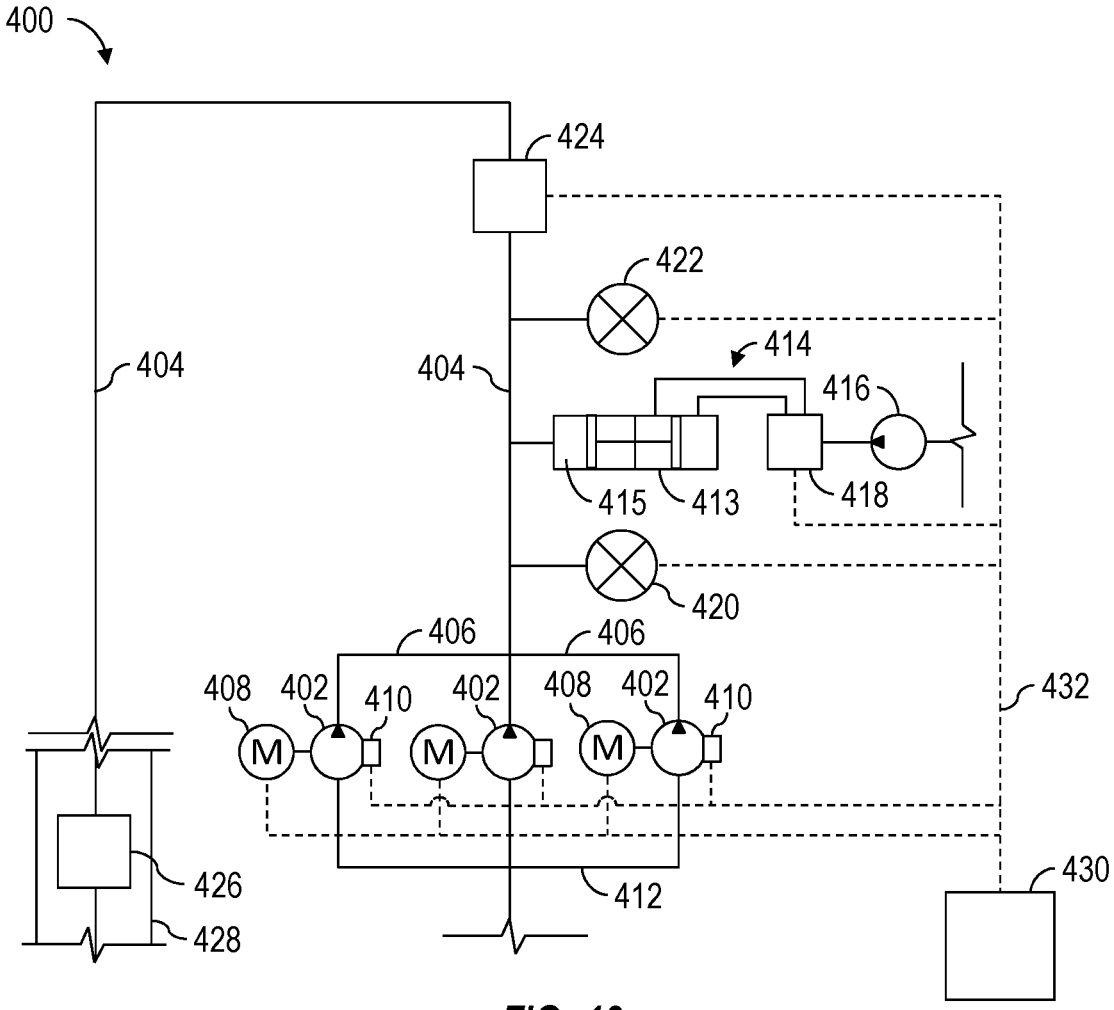
FIG. 13 is a schematic view of at least a portion of an example implementation of apparatus according to one or more aspects of the present disclosure.

FIG. 13 is a schematic view of at least a portion of an example implementation of a pressure pulsation dampening system 400 operable to dissipate or otherwise reduce magnitude of the pressure pulsation in drilling fluid pumped downhole by a plurality of drilling fluid pumps 402 via a common pressurized drilling fluid delivery line 404 according to one or more aspects of the present disclosure. The dampening system 400 may comprise one or more features of the wellsite system 100 shown in FIG. 1 and the pressure pulsation dampening system 300 shown in FIG. 4.

The dampening system 400 may comprise, be connected with, or otherwise be utilized with the fluid pumps 402 collectively operable to pump drilling fluid along the drilling fluid line 404. The pumps 402 may be fluidly connected with the drilling fluid line 404 via individual pump lines 406. Each fluid pump 402 may be driven by a corresponding motor 408, such as a hydrocarbon engine or an electric motor. A position sensor 410 may be disposed in association with each pump 402 and/or motor 408. Each position sensor 410 may be operable to generate signals or information indicative of operating state, phase, or position of the corresponding pump 402. Fluid inlets of the pumps 402 may be fluidly connected with a source of the drilling fluid (not shown) via system of suction lines 412. The drilling fluid line 404 may be or comprise fluid conduits, a fluid swivel, a kelly, a top drive, and the drill string.

The dampening system 400 may further comprise one or more pressure pulse generators 414 fluidly connected along the drilling fluid line 404 and operable to input pressure pulses into the drilling fluid line 404 having intended magnitude, wavelength, frequency, and/or phase. The pressure generator 414 may comprise a housing 413 and an internal chamber 415 configured to receive and expel the drilling fluid for a predetermined period of time and at a predetermined flow rate, pressure, and frequency. The pressure generator 414 may be or comprise a fluid cylinder operable receive and discharge a predetermined volume of drilling fluid from and into the drilling fluid line 404 to impart the pressure pulses into the drilling fluid line 404. The pressure pulse generator 414 may be driven, for example, by a hydraulic or pneumatic pump 416 and controlled by a hydraulic or pneumatic valve 418 operable to control hydraulic or pneumatic flow to the housing 413. Other pressure pulse generators may be used instead of or in addition to the pressure pulse generator 414.

The dampening system 400 may further comprise one or more pressure sensors 420, 422 fluidly connected along the drilling fluid line 404 upstream and/or downstream from the pressure pulse generator 414. The pressure sensors 420, 422 may be operable to generate signals or information indicative of fluid pressure along the drilling fluid line 404 upstream and/or downstream from the pressure pulse generator 414 and, thus, indicate pressure pulsation profiles of the drilling fluid downstream from the pumps 402 and downstream from the pressure pulse generator 414.

The dampening system 400 may also comprise a surface telemetry device 424 fluidly connected with the drilling fluid line 404 at the wellsite surface and a downhole telemetry device 426 fluidly connected with the drilling fluid line 404 downhole. The downhole telemetry device 426 may form a portion of a BHA located within a wellbore 428. The surface and downhole telemetry devices 424, 426 may perform telemetry self-diagnostics, generating telemetry quality measurements. For example, the downhole telemetry device 426 may send an information stream designed to test the telemetry quality, which is affected by the pressure profile of the drilling fluid being pumped along the drilling fluid line 404. The surface telemetry device 424 may then receive the information stream and determine the telemetry quality based on the received information stream. The surface telemetry device 424 may also or instead send an information stream to the downhole telemetry device 426, which upon receiving the information stream, may send an information report (a telemetry quality signal) indicative of telemetry quality back to the surface telemetry device 424.

The motors 408, the position sensors 410, the pressure sensors 420, 422, the fluid pulse generator 414, and the surface telemetry device 424 may be communicatively connected with a controller 430 via corresponding electrical conductors 432. The signals or information generated by such devices 410, 414, 420, 422 may be transmitted to the controller 430, which may receive and process the signals or information and transmit corresponding control signals to the motors 408 and the fluid pulse generator 414 to control change or otherwise control the pressure profile of the drilling fluid being transferred through the drilling fluid line 404 to optimize the telemetry quality between the surface and downhole telemetry devices 424, 426. Similarly as described above with respect to the controller 320 and shown in FIGS. 4-12, the controller 430 may receive a computer program code (e.g., control commands or instructions), such as may be executed to calculate or otherwise determine optimal relative timing (i.e., operational phase differences) in the operation of the pumps 402 and/or optimal timing between the collective operation of the pumps 402 and the pressure pulse generator 414 that result in the optimal telemetry quality between the surface and downhole telemetry devices 424, 426. Accordingly, the controller 430 may continually (i.e., reiteratively) and in real time monitor relative timing between each of the pumps 402 based on the signals from the position sensors 410, the pressure fluctuation profile(s) along the drilling fluid line 404 based on the signals from the pressure sensor(s) 420, 422, and the telemetry quality based on the telemetry quality signal from the surface telemetry device 424. Based on such signals, the controller 430 may then in real time operate the pumps 408 and the pressure pulse generator 414 to optimize telemetry quality between the surface and downhole telemetry devices 424, 426, such as by performing timing sweeps or otherwise incrementally advancing or retarding relative operational timing between the pumps 402 and/or between the collective operation of the pumps 402 and the pressure pulse generator 414, until optimal telemetry quality between the surface and downhole telemetry devices 424, 426 is reached.

Communication between the controller 430 and various devices 408, 410, 414, 420, 422, 424 of the dampening system 400 may also or instead be accomplished via wireless communication means. However, for clarity and ease of understanding, such communication means are not depicted in FIG. 13, and a person having ordinary skill in the art will appreciate that such communication means are within the scope of the present disclosure.

Some of the sensors forming the pressure pulsation dampening systems 300, 400 may also be utilized in the context of prognostic equipment health management. For example, operational information generated by one or more of the position sensors, the pressure sensors, and the uphole and downhole telemetry devices may be used as or form the basis for a health index of corresponding pieces of equipment fluidly connected with the drilling fluid line. Multiple health indexes may be derived from the various measurements of pressure pulsations of the drilling fluid being pumped through the drilling fluid line. Health indexes may include operational efficiency, flow rates, operating pressures, pumping rates, pulsation magnitudes, and telemetry quality, among other examples, recorded with respect to time. Continuous tracking (e.g., monitoring and recordation) of such health indexes over time may be indicative of progressive degradation of pumping equipment, including the pump units 302 and other equipment fluidly connected with the drilling fluid line. Deterioration of a health index can be defined as a deviation from the health index established to be a healthy baseline. Such deviation can be positive or negative, depending on the physics of the deterioration.

Health index tracking may be integrated into or used in conjunction with other rig equipment health monitoring systems, which may then permit execution of various operations regarding the health of tracked equipment. For example, health monitoring systems may track health indexes over time and give notification and/or alarms when certain thresholds are met. Health monitoring systems may calculate and track the deterioration rate of the health indexes and anticipate timing when health thresholds will be exceeded. Timing may refer to a point in time or the amount of operational activity performed by a piece of equipment. Health monitoring systems may relate the progression of deterioration related to environmental conditions. Health index tracking may include recording of operating variables of pump units (e.g., load, speed, temperature, duty-cycle, type of drilling fluid, solids content, etc.) and correlating deterioration patterns against usage. Health index tracking may include recording deterioration patters in association with specific usage and/or operating conditions to fine-tune the anticipation of exceeding thresholds (i.e., remaining useful life prediction). Health monitoring systems may trigger action items related to the health of pumping equipment, such as maintenance or replacement. Upon breaching a health index threshold, health monitoring systems may be operable to notify personnel of such breach, shut down equipment, and/or permit equipment to run on diminished capabilities and/or performance.

Health index tracking may permit re-setting and/or identification of maintenance being performed and/or new equipment (e.g., pumps) being installed. In other words, a health index may be updated regarding a new health state being introduced. The health index obtained can be used in tandem with health indexes obtained from other equipment on the rig. An aggregated health index can be computed from each health index obtained at the drilling rig.

Figure 14:
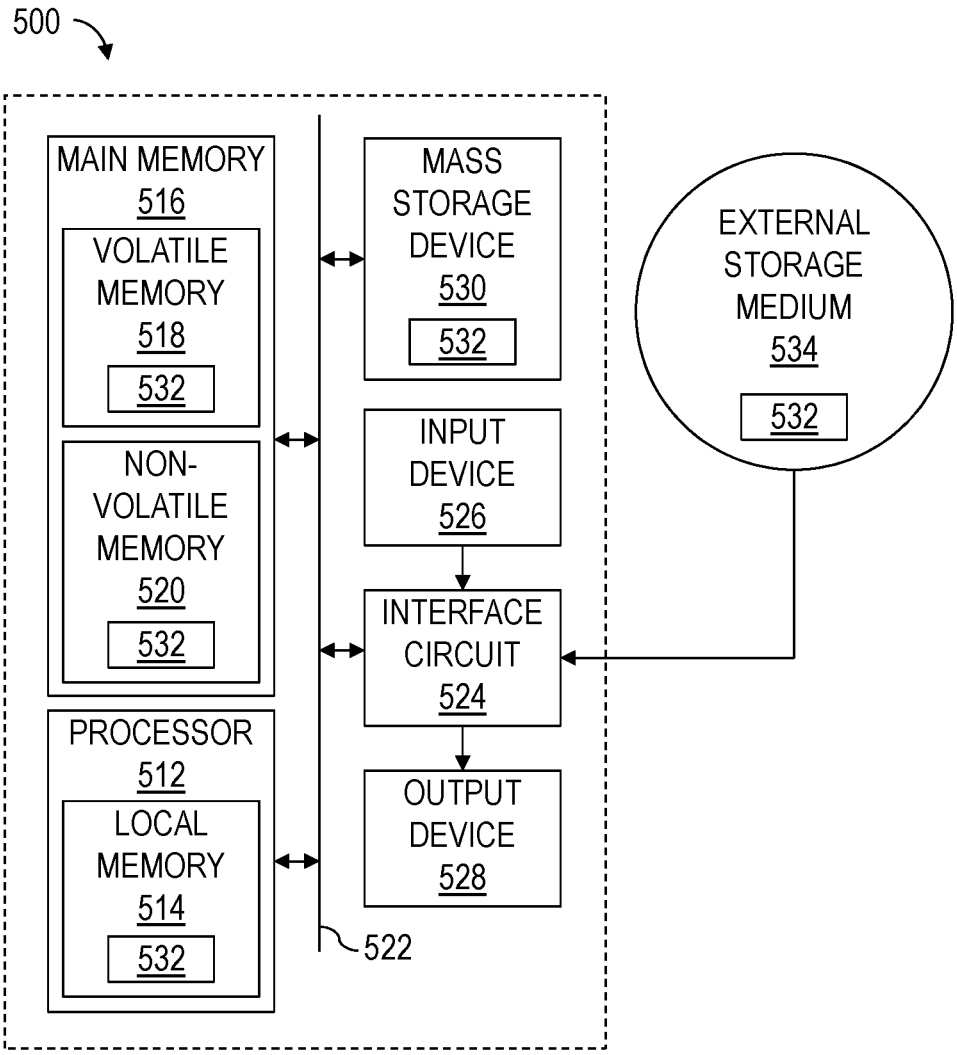
FIG. 14 is a schematic view of at least a portion of an example implementation of apparatus according to one or more aspects of the present disclosure.

FIG. 14 is a schematic view of at least a portion of an example implementation of a processing system 500 (or device) according to one or more aspects of the present disclosure. The processing system 500 may be or form at least a portion of one or more electronic devices shown in one or more of FIGS. 1-13. Accordingly, the following description refers to FIGS. 1-14, collectively.

The processing system 500 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing system 500 may be or form at least a portion of the controllers 138, 320, 430 utilized as part of wellsite system 100 and dampening systems 300, 400, respectively. Although it is possible that the entirety of the processing system 500 is implemented within one device, it is also contemplated that one or more components or functions of the processing system 500 may be implemented across multiple devices, some or an entirety of which may be at the wellsite and/or remote from the wellsite.

The processing system 500 may comprise a processor 512, such as a general-purpose programmable processor. The processor 512 may comprise a local memory 514, and may execute machine-readable and executable program code instructions 532 (i.e., computer program code) present in the local memory 514 and/or another memory device. The processor 512 may execute, among other things, the program code instructions 532 and/or other instructions and/or programs to implement the example methods and/or operations described herein. For example, the program code instructions 532, when executed by the processor 512 of the processing system 500, may cause the processor 512 to receive and process (e.g., compare) sensor data (e.g., sensor measurements) and output information indicative of operational and/or environmental parameters according to one or more aspects of the present disclosure. The program code instructions 532, when executed by the processor 512 of the processing system 500, may also or instead cause one or more portions or pieces of equipment to perform the example methods and/or operations described herein. The processor 512 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 512 include one or more INTEL microprocessors, microcontrollers from the ARM, PIC, and/or PICO families of microcontrollers, embedded soft/hard processors in one or more FPGAs.

The processor 512 may be in communication with a main memory 516, such as may include a volatile memory 518 and a non-volatile memory 520, perhaps via a bus 522 and/or other communication means. The volatile memory 518 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 520 may be, comprise, or be implemented by read-only memory, flash memory, and/or other types of memory devices. One or more memory controllers (not shown) may control access to the volatile memory 518 and/or non-volatile memory 520.

The processing system 500 may also comprise an interface circuit 524, which is in communication with the processor 512, such as via the bus 522. The interface circuit 524 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 524 may comprise a graphics driver card. The interface circuit 524 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing system 500 may be in communication with various sensors, video cameras, actuators, processing devices, equipment controllers, and other devices via the interface circuit 524. The interface circuit 524 can facilitate communications between the processing system 500 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 526 may also be connected to the interface circuit 524. The input devices 526 may permit human wellsite operators to enter the program code instructions 532, which may be or comprise control commands, operational parameters, physical properties, and/or operational set-points. The program code instructions 532 may further comprise modeling or predictive routines, equations, algorithms, processes, applications, and/or other programs operable to perform example methods and/or operations described herein. The input devices 526 may be, comprise, or be implemented by a keyboard, a mouse, a joystick, a touchscreen, a track-pad, a trackball, an isopoint, and/or a voice recognition system, among other examples. One or more output devices 528 may also be connected to the interface circuit 524. The output devices 528 may permit for visualization or other sensory perception of various data, such as sensor data, status data, and/or other example data. The output devices 528 may be, comprise, or be implemented by video output devices (e.g., an LCD, an LED display, a CRT display, a touchscreen, etc.), printers, and/or speakers, among other examples. The one or more input devices 526 and the one or more output devices 528 connected to the interface circuit 524 may, at least in part, facilitate the HMI devices described herein.

The processing system 500 may comprise a mass storage device 530 for storing data and program code instructions 532. The mass storage device 530 may be connected to the processor 512, such as via the bus 522. The mass storage device 530 may be or comprise a tangible, non-transitory storage medium, such as a floppy disk drive, a hard disk drive, a compact disk (CD) drive, and/or digital versatile disk (DVD) drive, among other examples. The processing system 500 may be communicatively connected with an external storage medium 534 via the interface circuit 524. The external storage medium 534 may be or comprise a removable storage medium (e.g., a CD or DVD), such as may be operable to store data and program code instructions 532.

As described above, the program code instructions 532 may be stored in the mass storage device 530, the main memory 516, the local memory 514, and/or the removable storage medium 534. Thus, the processing system 500 may be implemented in accordance with hardware (perhaps implemented in one or more chips including an integrated circuit, such as an ASIC), or may be implemented as software or firmware for execution by the processor 512. In the case of firmware or software, the implementation may be provided as a computer program product including a non-transitory, computer-readable medium or storage structure embodying computer program code instructions 532 (i.e., software or firmware) thereon for execution by the processor 512. The program code instructions 532 may include program instructions or computer program code that, when executed by the processor 512, may perform and/or cause performance of example methods, processes, and/or operations described herein.

In view of the entirety of the present disclosure, including the figures and the claims, a person having ordinary skill in the art will readily recognize that the present disclosure introduces an apparatus comprising a system for reducing pressure pulsations within drilling mud being pumped downhole by a plurality of pumps, wherein the system comprises: a pressure pulse generator fluidly connected with the drilling mud; a pressure sensor operable to generate a pressure signal indicative of the pressure pulsations within the drilling mud; a position sensor disposed in association with each pump and operable to generate a position signal indicative of operational timing of a corresponding one of the pumps; and a controller comprising a processor and memory storing computer program code, wherein the controller is communicatively connected with the pumps, the pressure pulse generator, the pressure sensor, and the position sensors. The controller is operable to: receive the pressure and position signals; cause the pumps to change relative operational timing of the pumps based on the position and pressure signals to reduce the pressure pulsations within the drilling mud; and cause the pressure pulse generator to impart pressure pulsations to the drilling mud based on the pressure signal to reduce the pressure pulsations within the drilling mud.

The controller may be further operable to cause the pumps to: incrementally change relative operational timing of the pumps while the controller is receiving the pressure signal; and maintain relative operational timing of each one of the pumps when the pressure signal is indicative of pressure pulsations having a smallest magnitude.

The controller may be further operable to cause the pressure pulse generator to: incrementally change operational timing of the pressure pulse generator while the controller is receiving the pressure signal; and maintain operational timing of the pressure pulse generator when the pressure signal is indicative of pressure pulsations having a smallest magnitude.

The system may further comprise: a surface telemetry device located at a wellsite surface; and a downhole telemetry device located downhole. The surface telemetry device and the downhole telemetry device may be operable to communicate with each other via mud-pulse telemetry. At least one of the surface telemetry device and downhole telemetry device may be operable to output a telemetry quality signal indicative of quality of the communications. The controller may be operable to: receive the telemetry quality signal; cause the pumps to change relative operational positions of the pumps based on the telemetry quality signal to improve the telemetry quality signal; and cause the pressure pulse generator to impart pressure pulsations to the drilling mud based on the telemetry quality signal to improve the telemetry quality signal. The controller may be further operable to cause the pumps to: incrementally change relative operational timing of the pumps while the controller is receiving the telemetry quality signal; and maintain relative operational timing of each one of the pumps when the telemetry quality signal is indicative of highest telemetry quality. The controller may be further operable to cause the pressure pulse generator to: incrementally change operational timing of the pressure pulse generator while the controller is receiving the telemetry quality signal; and maintain operational timing of the pressure pulse generator when the telemetry quality signal is indicative of highest telemetry quality.

The drilling mud may be pumped downhole via a fluid conduit at a wellsite surface and via a drill string extending within a wellbore, and the pressure pulse generator and the pressure sensor may be fluidly connected with the fluid conduit. The fluid conduit may be fluidly connected with outlets of the pumps, and the pressure pulsations within the drilling mud may be generated by the pumps.

The pressure sensor may be fluidly connected with the drilling mud between the pumps and the pressure pulse generator.

The pressure sensor may be fluidly connected with the drilling mud downstream from the pressure pulse generator.

The present disclosure also introduces an apparatus comprising a system for reducing pressure pulsations within drilling mud being pumped downhole by a plurality of pumps to thereby improve quality of mud-pulse telemetry, wherein the system comprises: a position sensor disposed in association with each pump and operable to generate a position signal indicative of operational timing of a corresponding one of the pumps; a surface telemetry device located at a wellsite surface; a downhole telemetry device located downhole, wherein the surface telemetry device and the downhole telemetry device are operable to communicate with each other via mud-pulse telemetry, and wherein at least one of the surface telemetry device and downhole telemetry device is operable to output a telemetry quality signal indicative of quality of the communications between the surface telemetry device and downhole telemetry device; and a controller comprising a processor and memory storing computer program code, wherein the controller is communicatively connected with the pumps, the position sensors, the surface telemetry device, and the downhole telemetry device. The controller is operable to: receive the position signal and the telemetry quality signal; and cause the pumps to change relative operational timing of the pumps based on the position signal and the telemetry quality signal to improve the quality of mud-pulse telemetry.

The controller may be further operable to cause the pumps to: incrementally change relative operational timing of the pumps while the controller is receiving the telemetry quality signal; and maintain relative operational timing of each one of the pumps when the telemetry quality signal is indicative of highest telemetry quality.

The system may further comprise a pressure pulse generator fluidly connected with the drilling mud, and the controller may be communicatively connected with the pressure pulse generator and may be further operable to cause the pressure pulse generator to impart pressure pulsations to the drilling mud based on the pressure signal to reduce the pressure pulsations within the drilling mud. The controller may be further operable to cause the pressure pulse generator to: incrementally change operational timing of the pressure pulse generator while the controller is receiving the telemetry quality signal; and maintain operational timing of the pressure pulse generator when the telemetry quality signal is indicative of highest telemetry quality.

The system may further comprise a pressure sensor operable to generate a pressure signal indicative of the pressure pulsations within the drilling mud, and the controller may be communicatively connected with the pressure sensor and may be further operable to: receive the pressure signal; and cause the pumps to change relative operational timing of the pumps based on the position and pressure signals to reduce the pressure pulsations within the drilling mud. The controller may be further operable to cause the pumps to: incrementally change relative operational timing of the pumps while the controller is receiving the position signal and the pressure signal; and maintain relative operational timing of each one of the pumps when the pressure signal is indicative of pressure pulsations having a smallest magnitude.

The drilling mud may be pumped downhole via a fluid conduit at the wellsite surface and via a drill string extending within a wellbore. The fluid conduit may be fluidly connected with outlets of the pumps, and the pressure pulsations within the drilling mud may be generated by the pumps.

The present disclosure also introduces a method for reducing pressure pulsations within drilling mud being pumped downhole by a plurality of pumps to thereby improve quality of mud-pulse telemetry, wherein the method comprises: generating a position signal indicative of operational timing of a corresponding one of the pumps; generating a pressure signal indicative of the pressure pulsations within the drilling mud; and operating a controller comprising a processor and memory storing computer program code to receive the pressure and position signals, cause the pumps to change operational timing relative to each other based on the position and pressure signals to reduce the pressure pulsations within the drilling mud, and cause a pressure pulse generator to impart pressure pulsations to the drilling mud based on the pressure signal to reduce the pressure pulsations within the drilling mud.

The method may comprise further operating the controller to cause the pumps to: incrementally change relative operational timing of the pumps while the controller is receiving the pressure signal; and maintain relative operational timing of each one of the pumps when the pressure signal is indicative of pressure pulsations having a smallest magnitude.

The method may comprise further operating the controller to cause the pressure pulse generator to: incrementally change operational timing of the pressure pulse generator while the controller is receiving the pressure signal; and maintain operational timing of the pressure pulse generator when the pressure signal is indicative of pressure pulsations having a smallest magnitude.

The method may further comprise: operating a surface telemetry device located at a wellsite surface and a downhole telemetry device located downhole to communicate with each other via mud-pulse telemetry; operating at least one of the surface telemetry device and downhole telemetry device to output a telemetry quality signal indicative of quality of the communications between the surface telemetry device and downhole telemetry device; and further operating the controller to receive the telemetry quality signal, cause the pumps to change relative operational positions of the pumps based on the telemetry quality signal to improve the telemetry quality signal, and cause the pressure pulse generator to impart pressure pulsations to the drilling mud based on the telemetry quality signal to improve the telemetry quality signal. The method may comprise further operating the controller to cause the pumps to: incrementally change relative operational timing of the pumps while the controller is receiving the telemetry quality signal; and maintain relative operational timing of each one of the pumps when the telemetry quality signal is indicative of highest telemetry quality. The method may further comprise operating the controller to cause the pressure pulse generator to: incrementally change operational timing of the pressure pulse generator while the controller is receiving the telemetry quality signal; and maintain operational timing of the pressure pulse generator when the telemetry quality signal is indicative of highest telemetry quality.

The drilling mud may be pumped downhole via a fluid conduit at a wellsite surface and via a drill string extending within a wellbore, and the pressure pulse generator and the pressure sensor may be fluidly connected with the fluid conduit. The fluid conduit may be fluidly connected with outlets of the pumps, and the pressure pulsations within the drilling mud may be generated by the pumps.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a system for reducing pressure pulsations within drilling mud being pumped downhole by a plurality of pumps, wherein the system comprises:

a pressure pulse generator fluidly connected with the drilling mud;

a pressure sensor operable to generate a pressure signal indicative of the pressure pulsations within the drilling mud;

a position sensor disposed in association with each pump and operable to generate a position signal indicative of operational timing of a corresponding one of the pumps; and a controller comprising a processor and memory storing computer program code, wherein the controller is communicatively connected with the pumps, the pressure pulse generator, the pressure sensor, and the position sensors, and wherein the controller is operable to:

receive the pressure and position signals;

cause the pumps to change relative operational timing of the pumps based on the position and pressure signals to reduce the pressure pulsations within the drilling mud; and cause the pressure pulse generator to impart pressure pulsations to the drilling mud based on the pressure signal to reduce the pressure pulsations within the drilling mud.

2. The apparatus of claim 1 wherein the controller is further operable to cause the pumps to:

incrementally change relative operational timing of the pumps while the controller is receiving the pressure signal; and maintain relative operational timing of each one of the pumps when the pressure signal is indicative of pressure pulsations having a smallest magnitude.

3. The apparatus of claim 1 wherein the controller is further operable to cause the pressure pulse generator to:

incrementally change operational timing of the pressure pulse generator while the controller is receiving the pressure signal; and maintain operational timing of the pressure pulse generator when the pressure signal is indicative of pressure pulsations having a smallest magnitude.

4. The apparatus of claim 1 wherein:

the system further comprises:

a surface telemetry device located at a wellsite surface; and a downhole telemetry device located downhole;

the surface telemetry device and the downhole telemetry device are operable to communicate with each other via mud-pulse telemetry;

at least one of the surface telemetry device and downhole telemetry device is operable to output a telemetry quality signal indicative of quality of the communications; and the controller is operable to:

receive the telemetry quality signal;

cause the pumps to change relative operational positions of the pumps based on the telemetry quality signal to improve the telemetry quality signal; and cause the pressure pulse generator to impart pressure pulsations to the drilling mud based on the telemetry quality signal to improve the telemetry quality signal.

5. The apparatus of claim 4 wherein the controller is further operable to cause the pumps to:

incrementally change relative operational timing of the pumps while the controller is receiving the telemetry quality signal; and maintain relative operational timing of each one of the pumps when the telemetry quality signal is indicative of highest telemetry quality.

6. The apparatus of claim 4 wherein the controller is further operable to cause the pressure pulse generator to:

incrementally change operational timing of the pressure pulse generator while the controller is receiving the telemetry quality signal; and maintain operational timing of the pressure pulse generator when the telemetry quality signal is indicative of highest telemetry quality.

7. The apparatus of claim 1 wherein:

the drilling mud is pumped downhole via a fluid conduit at a wellsite surface and via a drill string extending within a wellbore;

the pressure pulse generator and the pressure sensor are fluidly connected with the fluid conduit;

the fluid conduit is fluidly connected with outlets of the pumps; and the pressure pulsations within the drilling mud are generated by the pumps.

8. The apparatus of claim 1 wherein the pressure sensor is fluidly connected with the drilling mud between the pumps and the pressure pulse generator.

9. An apparatus comprising:

a system for reducing pressure pulsations within drilling mud being pumped downhole by a plurality of pumps to thereby improve quality of mud-pulse telemetry, wherein the system comprises:

a position sensor disposed in association with each pump and operable to generate a position signal indicative of operational timing of a corresponding one of the pumps;

a surface telemetry device located at a wellsite surface;

a downhole telemetry device located downhole, wherein the surface telemetry device and the downhole telemetry device are operable to communicate with each other via mud-pulse telemetry, and wherein at least one of the surface telemetry device and downhole telemetry device is operable to output a telemetry quality signal indicative of quality of the communications between the surface telemetry device and downhole telemetry device; and a controller comprising a processor and memory storing computer program code, wherein the controller is communicatively connected with the pumps, the position sensors, the surface telemetry device, and the downhole telemetry device, and wherein the controller is operable to:

receive the position signal and the telemetry quality signal; and cause the pumps to change relative operational timing of the pumps based on the position signal and the telemetry quality signal to improve the quality of mud-pulse telemetry.

10. The apparatus of claim 9 wherein the controller is further operable to cause the pumps to:

incrementally change relative operational timing of the pumps while the controller is receiving the telemetry quality signal; and maintain relative operational timing of each one of the pumps when the telemetry quality signal is indicative of highest telemetry quality.

11. The apparatus of claim 9 wherein the system further comprises a pressure pulse generator fluidly connected with the drilling mud, and wherein the controller is communicatively connected with the pressure pulse generator and further operable to cause the pressure pulse generator to impart pressure pulsations to the drilling mud based on the pressure signal to reduce the pressure pulsations within the drilling mud.

12. The apparatus of claim 11 wherein the controller is further operable to cause the pressure pulse generator to:

incrementally change operational timing of the pressure pulse generator while the controller is receiving the telemetry quality signal; and maintain operational timing of the pressure pulse generator when the telemetry quality signal is indicative of highest telemetry quality.

13. The apparatus of claim 9 wherein the system further comprises a pressure sensor operable to generate a pressure signal indicative of the pressure pulsations within the drilling mud, and wherein the controller is communicatively connected with the pressure sensor and further operable to:

receive the pressure signal; and cause the pumps to change relative operational timing of the pumps based on the position and pressure signals to reduce the pressure pulsations within the drilling mud.

14. The apparatus of claim 13 wherein the controller is further operable to cause the pumps to:

incrementally change relative operational timing of the pumps while the controller is receiving the position signal and the pressure signal; and maintain relative operational timing of each one of the pumps when the pressure signal is indicative of pressure pulsations having a smallest magnitude.

15. A method for reducing pressure pulsations within drilling mud being pumped downhole by a plurality of pumps to thereby improve quality of mud-pulse telemetry, wherein the method comprises:

generating a position signal indicative of operational timing of a corresponding one of the pumps;

generating a pressure signal indicative of the pressure pulsations within the drilling mud; and operating a controller comprising a processor and memory storing computer program code to:

receive the pressure and position signals;

cause the pumps to change operational timing relative to each other based on the position and pressure signals to reduce the pressure pulsations within the drilling mud; and cause a pressure pulse generator to impart pressure pulsations to the drilling mud based on the pressure signal to reduce the pressure pulsations within the drilling mud.

16. The method of claim 15 further comprising operating the controller to cause the pumps to:

incrementally change relative operational timing of the pumps while the controller is receiving the pressure signal; and maintain relative operational timing of each one of the pumps when the pressure signal is indicative of pressure pulsations having a smallest magnitude.

17. The method of claim 15 further comprising operating the controller to cause the pressure pulse generator to:

incrementally change operational timing of the pressure pulse generator while the controller is receiving the pressure signal; and maintain operational timing of the pressure pulse generator when the pressure signal is indicative of pressure pulsations having a smallest magnitude.

18. The method of claim 15 further comprising:

operating a surface telemetry device located at a wellsite surface and a downhole telemetry device located downhole to communicate with each other via mud-pulse telemetry;

operating at least one of the surface telemetry device and downhole telemetry device to output a telemetry quality signal indicative of quality of the communications between the surface telemetry device and downhole telemetry device; and further operating the controller to:

receive the telemetry quality signal;

cause the pumps to change relative operational positions of the pumps based on the telemetry quality signal to improve the telemetry quality signal; and cause the pressure pulse generator to impart pressure pulsations to the drilling mud based on the telemetry quality signal to improve the telemetry quality signal.

19. The method of claim 18 further comprising operating the controller to cause the pumps to:

incrementally change relative operational timing of the pumps while the controller is receiving the telemetry quality signal; and maintain relative operational timing of each one of the pumps when the telemetry quality signal is indicative of highest telemetry quality.

20. The method of claim 18 further comprising operating the controller to cause the pressure pulse generator to:

incrementally change operational timing of the pressure pulse generator while the controller is receiving the telemetry quality signal; and maintain operational timing of the pressure pulse generator when the telemetry quality signal is indicative of highest telemetry quality.

* * * * *